US008406454B2

(12) United States Patent
Bar

(10) Patent No.: US 8,406,454 B2
(45) Date of Patent: Mar. 26, 2013

(54) METHOD AND SYSTEM FOR CUSTOMIZED SHOE FITTING BASED ON COMMON SHOE LAST USING FOOT OUTLINE COMPARISON AND INTERCHANGEABLE INSOLE ADAPTORS

(75) Inventor: Samuel Bar, Ramat Hasharon (IL)

(73) Assignee: Comodo Technologies Ltd., Ramat Hasharon (IL)

( * ) Notice: Subject to any disclaimer, the term of this patent is extended or adjusted under 35 U.S.C. 154(b) by 1031 days.

(21) Appl. No.: 11/922,958

(22) PCT Filed: Jun. 21, 2006

(86) PCT No.: PCT/IL2006/000726

§ 371 (c)(1),
(2), (4) Date: Jan. 28, 2009

(87) PCT Pub. No.: WO2007/000758

PCT Pub. Date: Jan. 4, 2007

(65) Prior Publication Data

US 2009/0208113 A1 Aug. 20, 2009

Related U.S. Application Data

(60) Provisional application No. 60/693,799, filed on Jun. 27, 2005.

(51) Int. Cl.
*G06K 9/00* (2006.01)

(52) U.S. Cl. ..... 382/100

(58) Field of Classification Search ..... None
See application file for complete search history.

(56) References Cited

U.S. PATENT DOCUMENTS

| | | | | | |
|---|---|---|---|---|---|
| 2,141,193 | A * | 12/1938 | Mott | 378/164 |
| 4,268,980 | A * | 5/1981 | Gudas | 36/43 |
| 5,025,476 | A * | 6/1991 | Gould et al. | 382/115 |
| 5,339,252 | A * | 8/1994 | White et al. | 700/98 |
| 5,987,778 | A * | 11/1999 | Stoner | 36/1.5 |
| 6,163,971 | A * | 12/2000 | Humphries et al. | 33/515 |
| 6,289,107 | B1 * | 9/2001 | Borchers et al. | 382/100 |
| 6,331,893 | B1 * | 12/2001 | Brown et al. | 356/601 |
| 6,735,547 | B1 | 5/2004 | Yfantis | |
| 6,741,728 | B1 * | 5/2004 | Genest | 382/115 |
| 6,829,377 | B2 * | 12/2004 | Milioto | 382/128 |
| 7,089,152 | B2 * | 8/2006 | Oda et al. | 702/182 |
| 7,249,426 | B2 * | 7/2007 | Romano et al. | 36/93 |
| 2002/0157266 | A1 * | 10/2002 | Dowdell | 33/6 |

(Continued)

FOREIGN PATENT DOCUMENTS

| | | |
|---|---|---|
| GB | 189288 | 11/1922 |
| WO | WO 2007/000758 | 1/2007 |

*Primary Examiner* — Claire X Wang
*Assistant Examiner* — Avinash J Yentrapati
(74) *Attorney, Agent, or Firm* — Pearl Cohen Zedek Latzer, LLP

(57) ABSTRACT

A method for shoe fitting includes identifying outer foot outlines defining outer boundaries of feet of a user, and inner foot outlines defining weight-bearing areas of the feet in a computer-readable image of the feet. Weighted foot outlines are calculated based on the outer and inner foot outlines. A plurality of unfilled shoes are defined by a common shoe last having a last bottom outline, and sets of different left and right interchangeable insole adapters for insertion into the unfilled shoes are provided. The adapters match the last bottom outline and have respective adapter outlines. The weighted foot outlines are compared with the adapter outlines, to determine an optimal shoe size of a pair of shoes out of the plurality of the unfilled shoes, and to select left and right insole adapters from the sets of the interchangeable insole adapters whose adapter outlines best match the weighted foot outlines.

23 Claims, 33 Drawing Sheets

U.S. PATENT DOCUMENTS

2004/0073407 A1* 4/2004 Nguyen et al. ..... 702/194
2004/0074112 A1* 4/2004 Gislason ..... 36/97
2004/0148804 A1 8/2004 Romano et al.
2005/0028109 A1* 2/2005 Richards et al. ..... 715/823
2005/0049816 A1* 3/2005 Oda et al. ..... 702/127
2005/0171456 A1* 8/2005 Hirschman et al. ..... 600/592
2006/0103852 A1* 5/2006 Klaveness ..... 356/601
2007/0079532 A1* 4/2007 Ramirez ..... 36/140
2007/0163147 A1* 7/2007 Cavanagh et al. ..... 36/44
2009/0293641 A1* 12/2009 Clausen et al. ..... 73/862.046

* cited by examiner

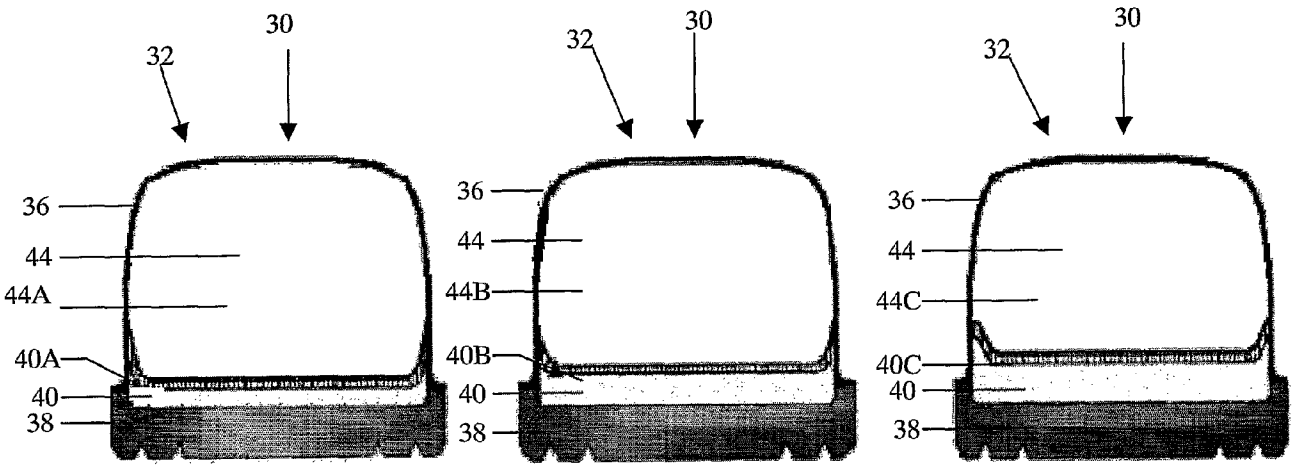
Fig. 5A
Fig. 5B
Fig 5C
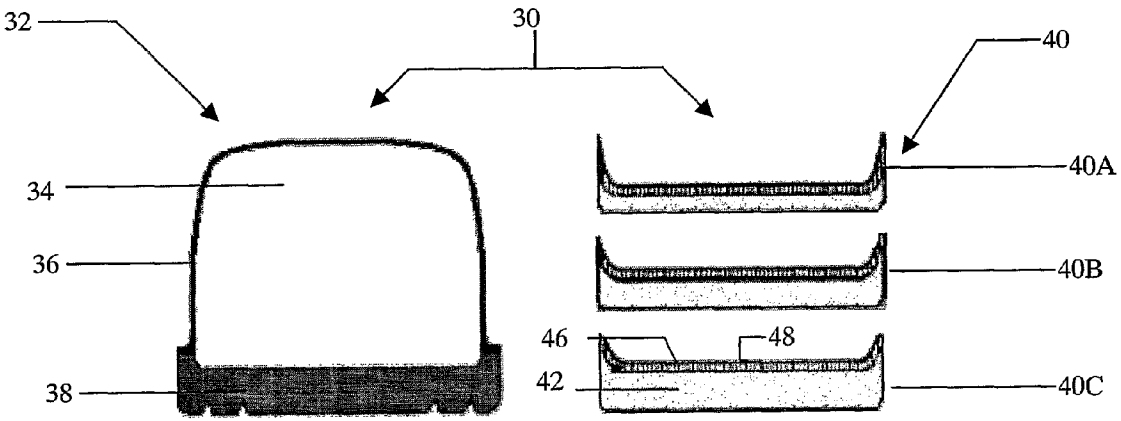
FIG. 4

40B
52B
54B
56B 40B
40A
52B
52A
54B, 54A
56B,56A 40C
40B
52C
52B
54B, 54C
56, 56C 40B
40D
52B
52D
54D
54B
56D,56B
58D $L_{L1}$
S1
20C
$L_F$
10
A1
$A_{L1}$
$A_{F1}$
B1
D1

$L_{L2}$
S2
20D
10
$L_F$
20E
A2
$A_{L2}$
$A_{F2}$
B2
D2

20D
20E $L_{L3}$
S3
10
20F
D3

21

115

METHOD AND SYSTEM FOR CUSTOMIZED SHOE FITTING BASED ON COMMON SHOE LAST USING FOOT OUTLINE COMPARISON AND INTERCHANGEABLE INSOLE ADAPTORS

CROSS-REFERENCE TO RELATED APPLICATIONS

This application claims the benefit of U.S. Provisional Patent Application 60/693,799, filed Jun. 27, 2005, which is incorporated herein by reference.

FIELD OF THE INVENTION

The present invention relates generally to shoe fitting, and particularly to methods and systems for automated fitting of shoes and insole adapters.

BACKGROUND OF THE INVENTION

Ill-fitting shoes can lead to pain, discomfort and a variety of foot illnesses, including inflammatory sores and blisters, hard corns, ingrown nails, calluses and impinged nerves in the foot. Diabetic patients may not feel pain or discomfort when a shoe is tight, and therefore a good fitting is particularly important to avoid foot illnesses.

Feet may sometimes be classified into three categories: Ectomorph (i.e., tall, slender, long-boned and slim), Mesomorph (i.e., stocky, muscular, heavy-boned) and muscled Endomorph (i.e., fleshy, plump, small-boned and fatty). Yet no particular physique entirely matches any one of these categories. Rather, most feet are a combination of the three categories, with one type being dominant. Thus, it is practically impossible to define a "normal foot."

In 1982 the national Prescription Footwear Association completed the measurement of 6,800 pairs of adult men and women's feet in 23 cities. Not a single perfectly matched pair was found. Most people have one foot larger than the other. Two shoes of the same length size and width, from different shoe lasts, do not have the same interior shape, and do not fit a given customer foot equally well. A customer, even a customer who is not an orthopedic patient, may have a foot that is the same length and width as a given shoe, but the shoe may nevertheless not provide a good fit.

Known shoe fitting methods tend to describe feet in terms of length, and possibly also width, generally a ball width. Yet, as will be shown in FIG. 1, the foot outline 10 is a complex shape, which cannot be adequately described by any two dimensions. Indeed, a large plurality of points needs to be considered, essentially forming a complete outline of the foot.

A shoe last is a mold over which the shoe is made. The shoe last gives the shoe its shape. Different shoe patterns, sizes and widths are derived from the shoe last. Hence, the shoe-last shape determines the fit and feel of the shoe on a specific foot. Shoes are often provided with interchangeable insoles (referred to herein as an insole adapters, or adapters for brevity when there are more than the standard pair comes with the shoe), which follow the outline of the bottom of the shoe last.

The last bottom outline is the outline derived from the template cut from the bottom side of the shoe last, i.e., the part that interfaces with the insole, and depends on the shoe size, width, and design. The insole pattern substantially follows the last-bottom outline.

The methods and systems described herein refer to shoes having interchangeable insole adapters. The standard insoles provided with the shoes define different inner volumes according to the shoe last.

It is important to note that shoes having the same length and width sizes but different designs may have different shapes, hence different last-bottom outlines, or insole patterns. The weight-bearing area provided by the outline of the last-bottom outline has an important influence on comfort.

Another parameter to consider is the shoe girth, as illustrated in FIG. 2A. For a given shoe last 16, the shoe girth is the shoe cross-section at a given location, for example, along the ball width 16A, or along a waist width 16B, or along an instep girth 16C. For the given shoe last 16, and at that location, the girth determines the shoe volume.

Moreover, it is known that shoe sizes are not always consistent. Hence, even the most exacting foot measuring of length and width is still confronted with the problem of the inconsistency of shoes size, width and shapes.

The foregoing issues have been addressed by several patents and patent applications, for example U.S. Patent Application Publications 2004/0148804, 2005/0049816, 2002/0157266 and 2005/0028109, and U.S. Pat. Nos. 6,331,893, 6,741,728, 6,735,547 and 6,289,107, whose disclosures are incorporated herein by reference.

As another example, in a press release dated Jan. 17, 2006 (after the priority date of the present patent application), the Timberland Company (Stratham, N.H.) announced a fitting system called PreciseFit™, in which each box of shoes is supplied with a set of inserts of varying thicknesses that lock on to a removable footbed.

SUMMARY OF THE INVENTION

Embodiments of the present invention provide methods and systems for automated shoe fitting. In some embodiments, pairs of unfinished shoes (i.e., shoes having no insole adapters) of different sizes, derived from a common shoe last are provided and stocked. Additionally, sets of insole adapters defined by the same shoe last are provided. For a given shoe size, different insole adapter differ from one another by their topography, i.e., by their thickness distribution at different areas such as the heel, forefront and/or arch sections. As such, different insole adapters, when inserted into the shoes, define different inner volumes of the shoes.

The methods and systems described herein automatically fit a pair of unfinished shoes and a pair of insole adapters to the feet of a particular customer. In some embodiments, contours defining outlines of the customer's feet are automatically identified in a computer-readable image of the feet. The shoe size and the appropriate left and right insole adapters are selected based on the identified outlines.

There is therefore provided, in accordance with an embodiment of the present invention, a computer-implemented method for shoe fitting, including:

providing a plurality of unfilled shoes defined by a common shoe last selected by a user and having a last bottom outline, and sets of interchangeable insole adapters for insertion into the unfilled shoes, wherein the adapters match the last bottom outline of the common shoe last;

identifying outlines of feet of the user in a computer-readable image of the feet;

determining an optimal shoe size of a pair of shoes selected from the plurality of unfilled shoes, and selecting left and right insole adapters from the sets of interchangeable insole adapters by comparing the outlines of the feet to last bottom outlines of the shoes and of the insole adapters, so as to best match the identified outlines; and providing to the user the selected pair of shoes having the selected left and right insole adapters inserted therein for optimal fit.

In an embodiment, the insole adapters have different topographies with respect to one another, so as to modify an inner volume of the unfilled shoes when inserted therein. In another embodiment, the insole adapters are color-coded. In yet another embodiment, identifying the outlines includes placing the feet of the user on a platform, irradiating the feet using a collimated Near Infra Red light source and capturing the irradiated light using a camera so as to obtain the computer-readable image.

In still another embodiment, identifying the outlines includes identifying inner foot outlines defining weight-bearing areas of the feet and outer foot outlines defining outer boundaries of the feet in the computer-readable image. Identifying the outlines may include calculating weighted foot outlines based on the inner and outer foot outlines, and selecting the left and right insole adapters responsively to the weighted foot outlines.

In an embodiment, determining the shoe size includes determining left and right shoe sizes, and choosing a maximum size of the left and right shoe sizes. Determining the shoe size may include attempting to select an insole adapter of lowered section or higher volume prior to advancing to a larger shoe size.

In another embodiment, the sets of left and right insole adapters include insole adapters that differ in a topography of at least one of a heel section, a forefront section and an arch section, and selecting the insole adapters includes estimating a topography of the feet using the identified outlines and selecting the left and right insole adapters that best match the topography of the feet.

In yet another embodiment, selecting the insole adapters includes selecting an adapter including a forward-pushing heel section.

There is additionally provided, in accordance with an embodiment of the present invention, apparatus for performing automated shoe fitting, including:

an optical imaging subsystem, which is arranged to obtain a computer-readable image of feet of a user; and a processor, which is arranged to identify outlines of the feet in the computer-readable image, to determine an optimal shoe size of a pair of shoes selected from a plurality of unfilled shoes defined by a common shoe last selected by a user and having a last bottom outline, and to select left and right insole adapters from sets of interchangeable insole adapters defined by the common shoe last by comparing the outlines of the feet to last bottom outlines of the shoes and of the insole adapters, so as to best match the identified outlines and provide to the user filled shoes of an optimal size with the selected left and right insole adapters inserted therein.

In an embodiment, the apparatus includes a platform for placing the feet, the platform including a material that is substantially transparent to Near Infra Red light used by the optical imaging system. Additionally or alternatively, the platform is opaque to visible light. In another embodiment, the computer-readable image is obtained when the feet are fitted with socks reflecting the wavelength used by the optical imaging system.

In still another embodiment, the apparatus includes a display, which is arranged to display at least one of the selected left and right insole adapters, the selected shoe size, video streaming of the feet reflected captured images, three-dimensional images of the selected left and right insole adapters, and the identified foot outlines.

In an embodiment, the apparatus includes an input device, which is arranged to accept input from the user specifying a desired shoe manufacturer and a desired shoe style that defines the common shoe last.

In another embodiment, the apparatus includes a database, which is arranged to hold at least one of outlines of the insole adapters, three-dimensional images of the insole adapters, additional data related to the insole adapters, and visual data related to the unfilled shoes.

There is also provided, in accordance with an embodiment of the present invention, a system for shoe fitting, including:

one or more shoe measurement stations, which are arranged to perform a measurement session with a user, each measurement station including:

an optical imaging subsystem, which is arranged to obtain a computer-readable image of feet of a user; and a processor, which is arranged to automatically identify contours defining outlines of the feet in the computer-readable image and to output to the user an identification of the measurement session;

one or more fitting stations, which are arranged to process measurement information produced by the measurement session so as to determine an optimal shoe size of a pair of shoes selected from a plurality of unfilled shoes defined by a common shoe last selected by the user and having a last bottom outline, and to select left and right insole adapters from sets of interchangeable insole adapters defined by the common shoe last, so as to select filled shoes of an optimal size; and one or more sales stations, which are arranged to perform a purchasing transaction with the user for purchasing the selected filled shoes having the selected left and right insole adapters inserted therein, wherein the measurement stations, fitting stations and sales stations are interconnected by a communication network.

In an embodiment, the communication network includes a wireless network.

There is additionally provided, in accordance with an embodiment of the present invention, a shoe-and-adaptor system, including:

a first plurality of mass-produced shoes, of varying shoe-length sizes, each of said sizes provided in right and left shapes, said shoes defining last-bottom outlines of specific sizes and right and left shapes and further defining initial inner volumes, in which standard insoles, corresponding to said specific sizes and shapes, can be inserted, wherein said shoes are provided without said standard insoles; and a same plurality of adaptor sets, corresponding to said varying shoe-length sizes and right and left shapes, wherein each of said adaptor sets includes at least two interchangeable adaptors, having identical adaptor outlines but different topographies, and being configured for insertion to shoes, corresponding in size and shape, thus providing said shoes with adjustable final inner volumes.

There is further provided, in accordance with an embodiment of the present invention, a method of shoe fitting, including:

providing a shoe-and-adaptor system, which includes:

a first plurality of mass-produced shoes, of varying shoe-length sizes, each of said sizes provided in right and left shapes, said shoes defining last-bottom outlines of specific sizes and right and left shapes and further defining initial inner volumes, in which standard insoles, corresponding to said specific sizes and shapes, can be inserted, wherein said shoes are provided without said standard insoles;

a same plurality of adaptor sets, corresponding to said varying shoe-length sizes and right and left shapes, wherein each of said adaptor sets includes at least two interchangeable adaptors, having identical adaptor outlines but different topographies, and being configured for insertion to shoes, corresponding in size and shape, thus providing said shoes with adjustable final inner volumes;

obtaining right and left foot outlines;

automatically comparing said right and left foot outlines with right and left last-bottom-outline choices, said right and left last-bottom-outline choices varying by their respective shoe lengths sizes;

automatically selecting a right choice and a left choice from said right and left last-bottom-outline choices, based on said comparing;

automatically selecting a larger size of said right choice and said left choice, as a selected shoe-length size, as a first attempt;

automatically selecting adaptor sets, of right and left shapes, both corresponding to said selected shoe-length size;

automatically fitting said feet with right and left adaptors, from said sets of interchangeable adaptors, independently for each of said feet, to adjust said adjustable final inner volumes to said foot outlines, for each of said feet within said selected shoe-length size, based on said comparing.

There is additionally provided, in accordance with an embodiment of the present invention, a shoe-fitting apparatus, including:

a platform, substantially transparent in a near-infrared light range, on whose proximal side human feet are placeable, for obtaining foot outlines by near-infrared light reflection, said platform defining an x;y plane, parallel with said platform and a z-axis, perpendicular to said platform;

an optical system, which includes:

a light source, configured to irradiate said feet with a near-infrared light;

a mirror, on a distal side of said platform, for bending a light reflection from said feet and directing said light reflection to a light detecting system;

said light detecting system, for detecting said light reflection, arriving from said feet;

a computer, which is in signal communication with said light detecting system, and which is associated with a data bank, which includes:

a first plurality of mass-produced shoes, of varying shoe-length sizes, each of said sizes provided in right and left shapes, said shoes defining last-bottom outlines of specific sizes and right and left shapes and further defining initial inner volumes, in which standard insoles, corresponding to said specific sizes and shapes, can be inserted, wherein said shoes are provided without said standard insoles;

a same plurality of adaptor sets, corresponding to said varying shoe-length sizes and right and left shapes, wherein each of said adaptor sets includes at least two interchangeable adaptors, having identical adaptor outlines but different topographies, and being configured for insertion to shoes, corresponding in size and shape, thus providing said shoes with adjustable final inner volumes; and a user's interface, in communication with said computer.

There is also provided, in accordance with an embodiment of the present invention, a three-dimensional virtual plaster cast, having an upper surface, of an image captured by a camera, wherein said upper surface is defined by an outer outline and a lower surface is defined by an inner outline of a foot.

The present invention will be more fully understood from the following detailed description of the embodiments thereof, taken together with the drawings in which:

BRIEF DESCRIPTION OF THE DRAWINGS

FIG. 4 is a diagram that schematically illustrates cross-sections of a shoe and of a set of insole adapters, in accordance with an embodiment of the present invention;

FIGS. 5A-5C are diagrams that schematically illustrate cross sections of insole adapters fitted into shoes, in accordance with embodiments of the present invention;

DETAILED DESCRIPTION OF EMBODIMENTS

General Overview

Figure 1:
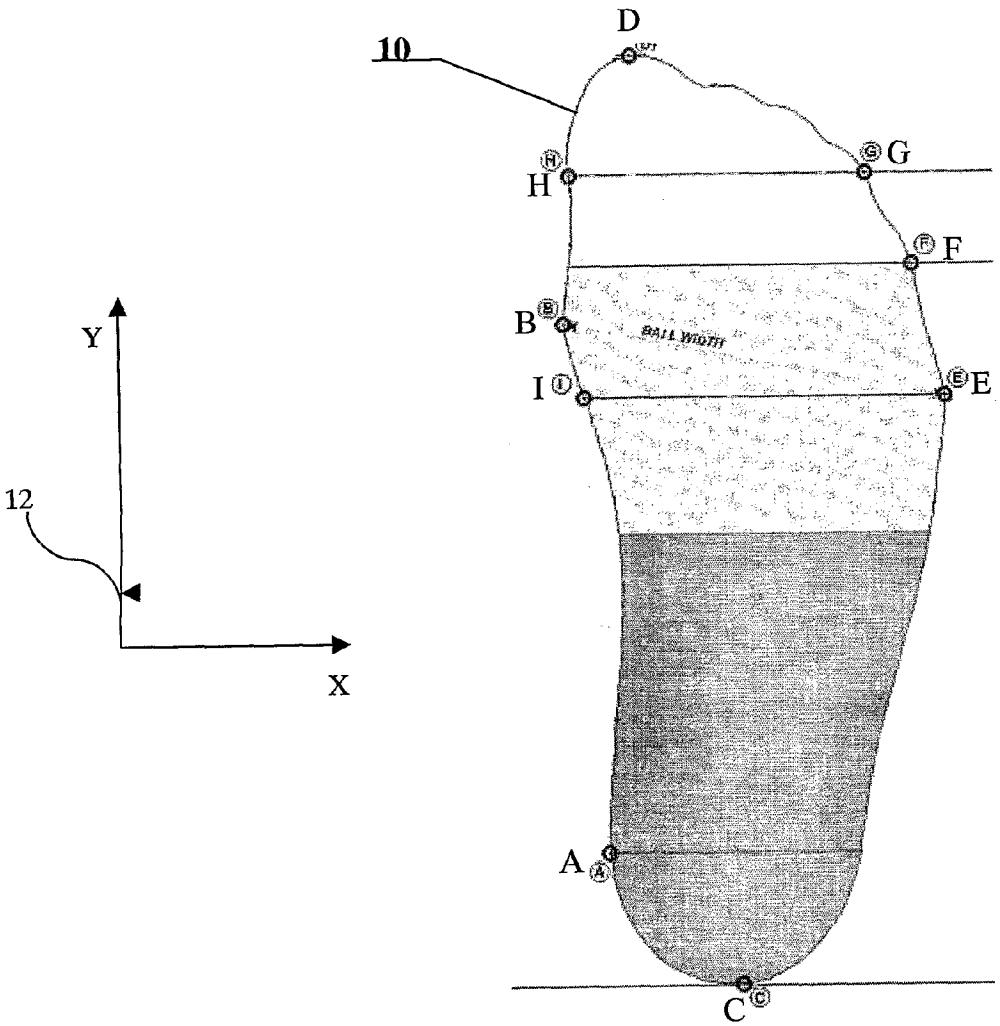
FIG. 1 is a diagram that schematically illustrates a foot outline, in accordance with an embodiment of the present invention.

The methods and systems described herein automatically determine the appropriate shoe size and select appropriate insole adapters to match the feet of a particular customer. In principle, standard, mass-produced shoes derived from a particular shoe last are used as a basis for the fit. For a given shoe size, sets of left and right insole adapters are pre-produced and provided. In each set, the insole adapters typically differ from one another by their topography as will be explained and demonstrated below. The methods and systems described herein automatically determine the appropriate shoe size and, within the determined shoe size, the appropriate left and right insole adapters. An optimal fit is achieved for each foot by Selecting particular left and right insole adapters (which may or may not have similar topographies) and inserting them into the standard, unfinished shoes.

As such, the methods and systems described herein provide the benefits of fast, accurate, personal fitting for mass produced shoes, while using only a limited variety of mass-produced adapters.

In an exemplary embodiment, the customer places his or her feet on the surface of a fitting apparatus, whose structure and functionality is described in detail hereinbelow. By performing a "fit by comparison" process, the fitting apparatus analyzes inner and outer foot outlines, and compares them with last base outlines of shoes, which are defined by the common last. The apparatus then determines the desired shoe size and selects an insole adapter that best matches each foot of the customer's. As noted above, the shoes and adapters are all derived from the same common last.

In some embodiments, the fitting processor calculates a weighted foot outline, which gives different relative weights to the inner and outer foot contours at different locations around the foot perimeter, thus improving the accuracy of the fit. For example, at the toe area, the outer foot outline is usually given a high weight. At other, less sensitive areas, more weight may be given to the inner outline in determining the desired insole adapter and shoe size.

In some embodiments, fitting and purchasing of shoes is performed at the same site. Standard mass produced, unfilled shoes manufactured and defined by the common last in different sizes, as well as the different insole adapter sets derived from the common last, are stocked separately. The fitting apparatus selects the desired shoe size and the optimal insole adapter for each foot. The appropriate adapters are then inserted into the standard shoes and provided to the customer. In alternative embodiments, the fitting process may be separate from the purchasing and/or measuring process. For example, a fitting apparatus can be located in a shopping mall. A customer may perform a measurement of his or her foot outlines, and purchase the shoes at a different occasion and/or place, such as online over the Internet. The results of the fitting session are made available for the customer in order to specify the desired shoe size and adapters in another location, as will be described below.

Thus, the methods and systems described herein provide automatic, real-time tailored shoe fitting at the point of sale, which fits the shoes, feet and insoles as a comprehensive system (i.e all parts are fitting to each other shoe-insole shares the same last. Feet adapted by the adaptors) Unlike known methods and systems, which base the fitting on a small number of parameters (e.g., length and width measurements), the methods and systems described herein provide a highly accurate fit based on the comparison between the outlines of each foot and the last bottom outlines of the selected shoe together with the ability to optimally fine-tune the fitting for each foot.

Overview of Shoe Lasts, Last Bottom Profiles and Foot Outlines

FIG. 1 schematically represents a foot outline 10, in accordance with an embodiment of the present invention. As can be seen, the foot outline is a complex shape, which cannot be described in terms of a small number of parameters, such as length and width. Indeed, a large plurality of points needs to be considered, essentially forming a complete outline of the foot. In practice, an actual continuous foot outline, similar to foot outline 10 of FIG. 1, should be acquired, typically in an x-y coordinate system 12.

Figure 2A:
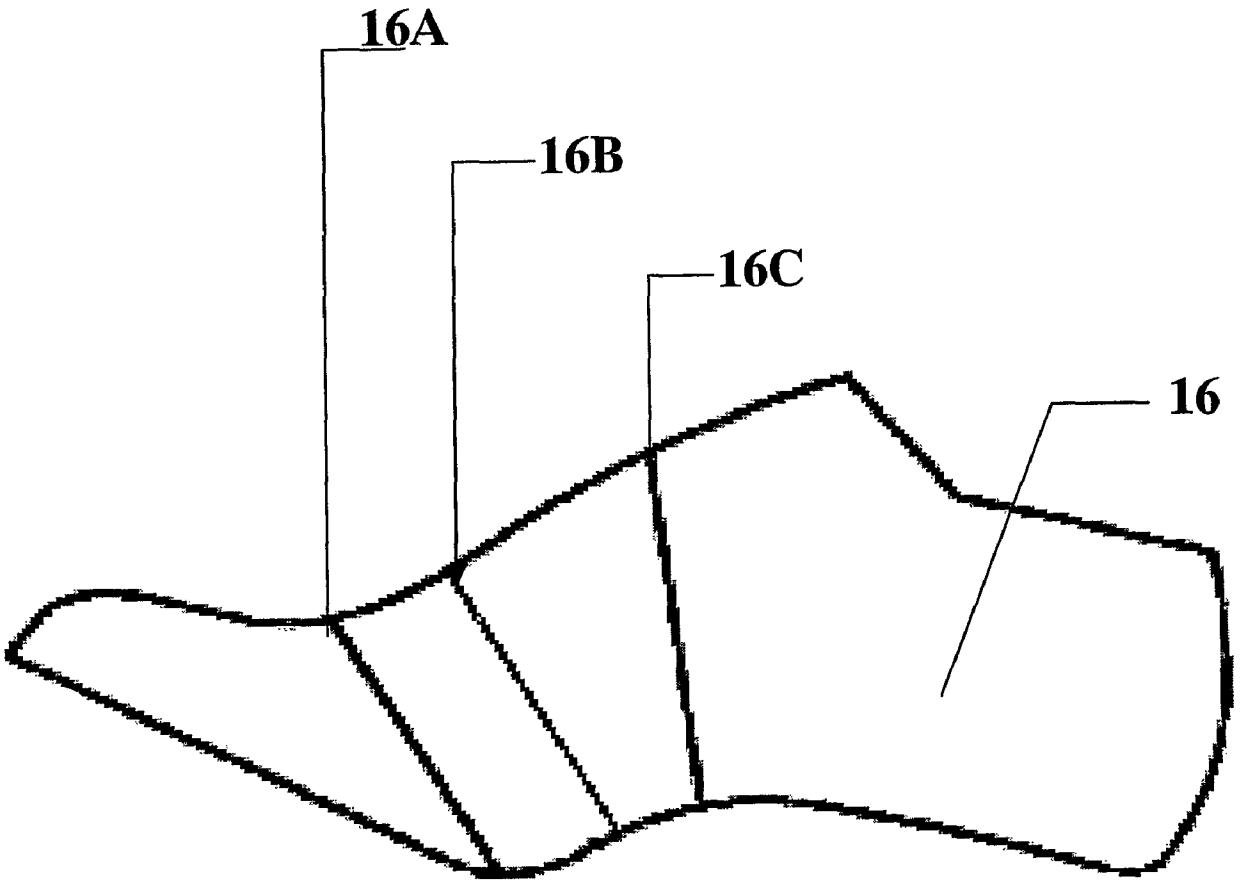
FIG. 2A is a diagram that schematically illustrates a shoe last and main girths, in accordance with an embodiment of the present invention.

FIG. 2A schematically illustrates a shoe last 16, in accordance with an embodiment of the present invention. Shoe last 16 comprises a mold over which the shoe is made. The shoe last gives the shoe its shape. Different shoe patterns, sizes and widths are derived from the shoe last. Hence, the shoe-last shape determines the fit and feel of the shoe on a specific foot. Several shoe girths are illustrated in FIG. 2A. For a given last 16, the shoe girth is the shoe cross-section at a given location, for example along the ball width 16A, or along a waist width 16B, or along an instep girth 16C. For the given last 16, and at that location, the girth determines the shoe volume. Changes in shoe sizes are formed by changes in last girths.

Figure 2C:
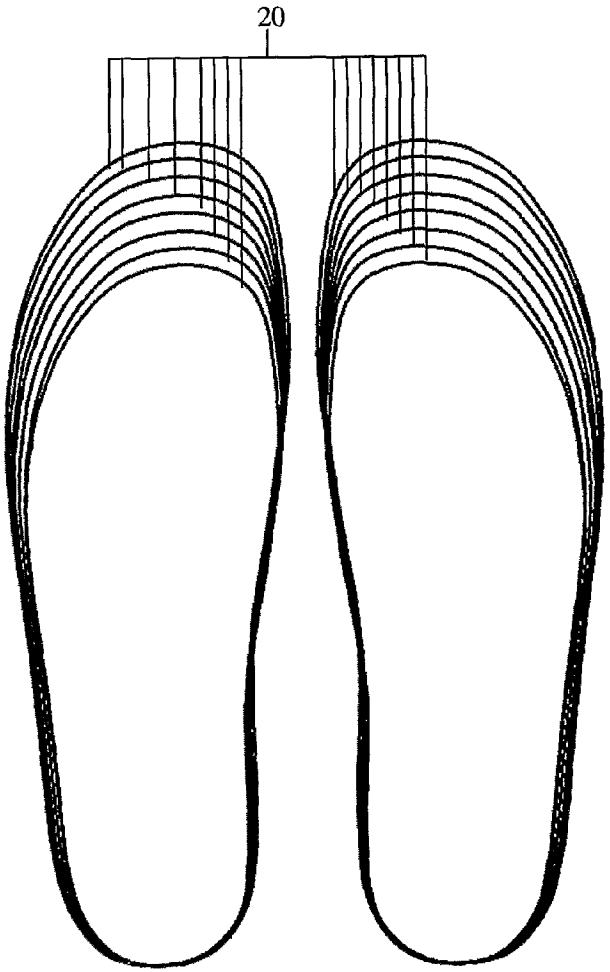
FIGS. 2B and 2C are diagrams that schematically illustrate last bottom outlines of different shoe sizes and designs, in accordance with an embodiment of the present invention.
Figure 2B:
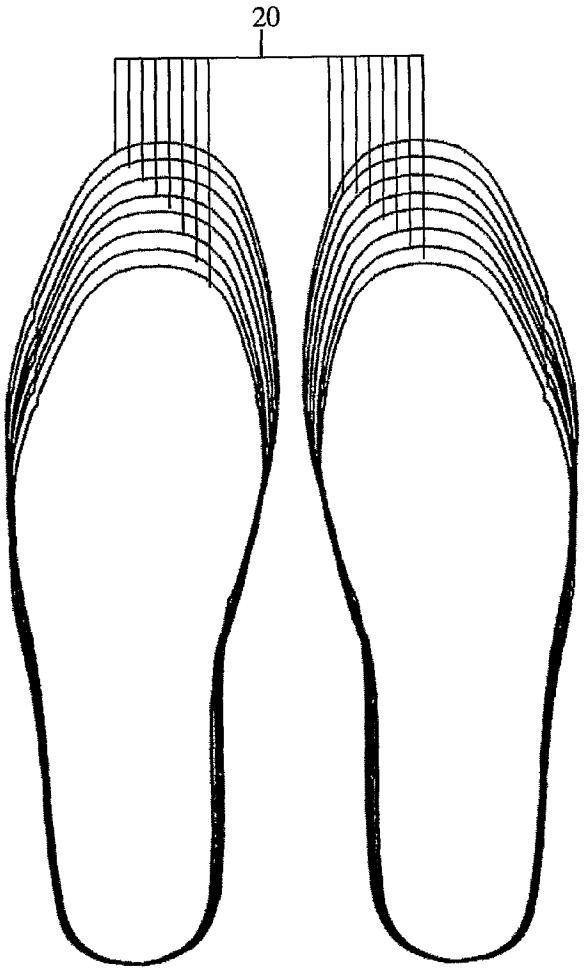

FIGS. 2B and 2C schematically illustrate last bottom outlines 20 for a regular width (standard insole width) and a range of shoe sizes from size 40 (EU) to size 47 (EU) in two different shoe designs. The bottom side of last 20 is the part that interfaces with the insole. It depends on the shoe size, width, and design. The insole pattern substantially follows the last-bottom outline 20. It is important to note that shoes of a same length and width sizes, but of different designs may have different shapes, hence different last-bottom outlines 20, or insole patterns.

The last bottom outlines 20 reflect "spread out" views of last bottoms, so that last bottom outlines of shoes of different-height heels are described on a common basis. Thus, it is possible to compare a foot outline with a last bottom outline on a flat surface, without being influenced by the height of a specific heel of a specific last and shoe design.

FIGS. 2D-2G illustrate last-bottom outlines 20 of a specific last model, varying in shoe length size from a length size 39 (EU) to a length size 42 (EU). Each last bottom outline 20 defines a width, such as W1, W2, W3, and W4, and a corresponding height, such as H1, H2, H3, and H4. As the shoe size increases, both the width and the corresponding height to that width increase.

As will be explained in detail hereinbelow, the methods and systems described herein image the feet of a user, and determine outer and inner foot contours. The outer and inner contours are subsequently used for shoe fitting.

Figures 3A, 3B:
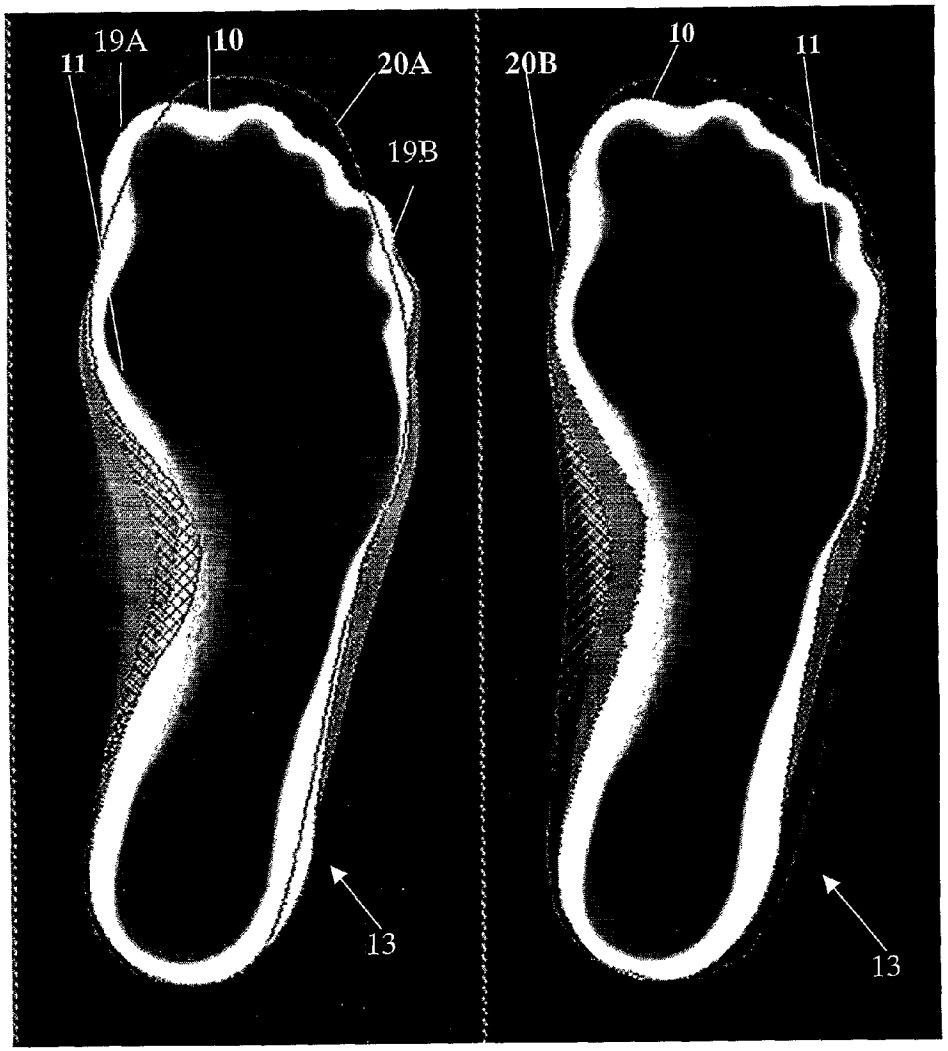
FIGS. 3A and 3B are diagrams that schematically illustrate a foot outline overlaid on different last bottom outlines of different shoe designs, in accordance with an embodiment of the present invention.

FIGS. 3A and 3B schematically illustrate a foot image 13 having a particular outer foot outline 10 and a particular inner foot outline 11, compared against different last bottom outlines 20A and 20B, respectively, each of a different shoe design. As seen in FIG. 3A, portions 19A and 19B of the foot outline 10 protrude outside the last bottom 20A, leading to a poor fit. As seen in FIG. 3B, the actual foot outline 10 fits well within, and is completely bounded by the last bottom outline 20B, thus ensuring a good fit. These Figs. illustrate the importance of a complete comparison between the actual foot outline 10 and the last bottom outline 20 for a proper shoe fitting.

FIGS. 3A and 3B further illustrate the concept of using an outer foot outline 10 and an inner foot outline 11. In the forefoot, the inner outline 11 may be the more weighty, in terms of importance, for fitting. Further, the structure of the insole adapter, and foot sensitivity to pressure in different places of the foot, are examples of factors that influence the weight, or relative significance, given the inner outline 11 and outer outline 10 in the comparing process. However, in the heel and toe areas, the outer outline 10 may be the more important outline. Comparing outlines is a powerful tool that does not require adding information of gender or age (men, women, and children) or of the applicable standard (American or European) of sizes.

Customized Fitting Using Standard Shoes and Insole Adapter Sets

FIG. 4 schematically illustrates a cross-sectional view of a last-based insole system 30, in accordance with an embodiment of the present invention. System 30 comprises a mass-produced shoe 32, of a specific size and shape, defining a shoe last bottom outline 20 (see FIGS. 2B-2G above) and further defining an initial inner volume 34, enclosed by a shoe upper 36 and a shoe outsole 38. A standard insole (not shown), corresponding to the specific size and shape of the shoe 32, can be inserted over the outsole 38 to complete the inner volume 34. However, the manufactured shoe 32 is provided without the standard insole, or any final insole, and therefore can be considered as manufactured in unfinished condition.

Additionally, system 30 comprises a set of two or more (and often three or more) interchangeable insole adapters 40, such as 40A, 40B and 40C. Adapters 40A-40C have similar outlines but different topographies, and are configured for insertion into the shoe 32. Adapters 40A-40C are used in a manner similar to standard insoles, yet they provide shoe 32 with a final inner volume 44, which may increased or decreased, as needed by the selection of the appropriate adapter.

Adapter 40B is sometimes referred to as a "regular" or "standard" adapter, having a standard height according to the perimeters and inner volume derived by the shoe last. Adapter 40A has a lowered section, generally at the forefoot area. Adapter 40C has a raised section, generally at the forefoot area.

Preferably the topographical differences between adjacent insole adapters (e.g., between adapters 40A and 40B or between adapters 40B and 40C) comprises a difference of height, for example, at the forefoot section, of about 1.5 to 3 mm, and preferably, 2.0 to 2.5. The topographical change is adapted to the anatomical structure of the foot being fitted.

In some embodiments, adapters 40 comprise a base layer 42, a cushioning layer 46 and an upper lining layer 48, laid on top of one another. Lining layer 48, which comes in contact with the user's feet, may comprise lining material such as sheep or pork leather, or synthetic materials such as micro fiber or PU. Cushioning layer 46 typically comprises soft material, which is preferably of a minimal compression set, for example, a latex foam, or PORON. Base layer 42 typically comprising a relatively hard material, which provides some shock absorption when walking. Layer 42 may comprise, for example, polyether, latex with cork, PU or other insole materials known in the art.

FIGS. 5A-5C further illustrate the cross-sectional view of the shoe and insole adapter system 30, with the adapter 40 inserted into shoe 32, in accordance with an embodiment of the present invention. When adapter 40A is inserted into shoe 32 (FIG. 5A), the final inner volume is 44A. When adapter 40B is inserted into shoe 32 (FIG. 5B), the final inner volume is 44B, which is somewhat smaller than the final inner volume 44A since adapter 40B is thicker than adapter 40A. When adapter 40C is inserted into shoe 32 (FIG. 5C), the final inner volume is 44C, which is somewhat smaller than the final inner volume 44B, since the adapter 40C is thicker than adapter 40B. Adapter 40C can be used for fitting of relatively narrow feet and may optionally comprise larger side spacers, which directly prevent a narrow foot from slipping sideways inside the shoe.

FIGS. 6A-6D schematically illustrate longitudinal views of system 30, with the adapters 40 inserted within shoes 32 showing the different adapter topographies, in accordance with an embodiment of the present invention.

Figure 6A:
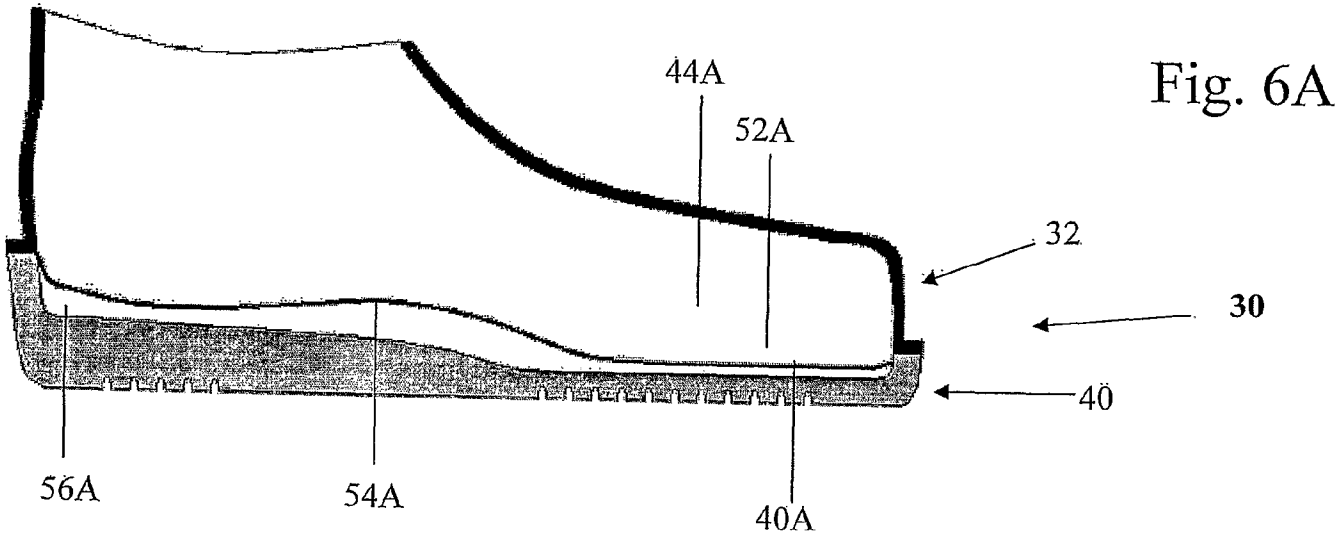
FIGS. 6A-6D are diagrams that schematically illustrate lengthwise cross-sections of shoes fitted with insole adapters, in accordance with embodiments of the present invention.
Figure 6B:
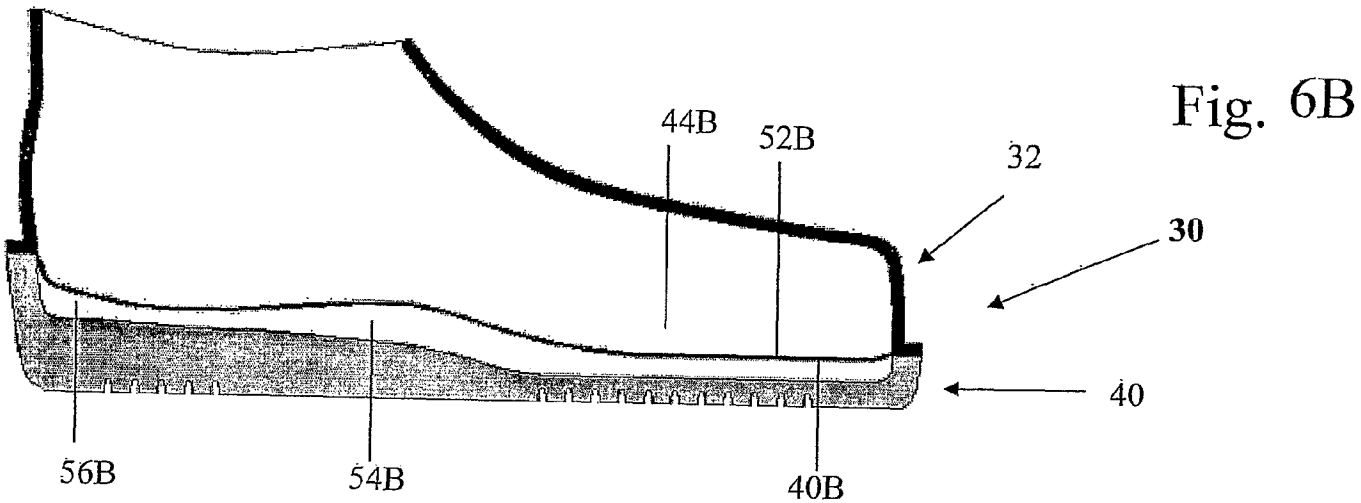

FIG. 6B schematically illustrates shoe 32 having adapter 40B (also referred to as the "regular" or "standard" adapter) inserted therein. This Figure illustrates a forefoot section 52B, an arch section 54B, and a heel section 56B, of adapter 40B, and the final inner volume 44B. For the sake of visual comparison, FIG. 6B is reproduced adjacently to each of FIGS. 6C, and 6D below.

FIG. 6A schematically illustrates shoe 32 with adapter 40A inserted therein. Adapter 40A has a lowered forefoot section, to provide a thinner insole than adapter-insole 40B, thus providing the shoe 32 with the final inner volume 44A, greater than the final inner volume 44B. This Figure illustrates a forefoot section 52A, an arch section 54A, and a heel section 56A, of adapter 40A. In accordance with an embodiment of the present invention, the topographies of adapters 40A and 40B differ primarily at the forefoot sections 52A and 52B, which is lowered, in the present example, while the heel sections 56A and 56B may be nearly the same. The arch section 54A is shaped to provide continuity between the heel and forefoot sections. The situation of FIG. 6A is applicable, for example, in cases in which the shoe 32 with a standard insole would be too tight in width.

It will be appreciated that other topographies are similarly possible and will be apparent to those skilled in the art. For example, the heel sections may be different too.

Figure 6C:
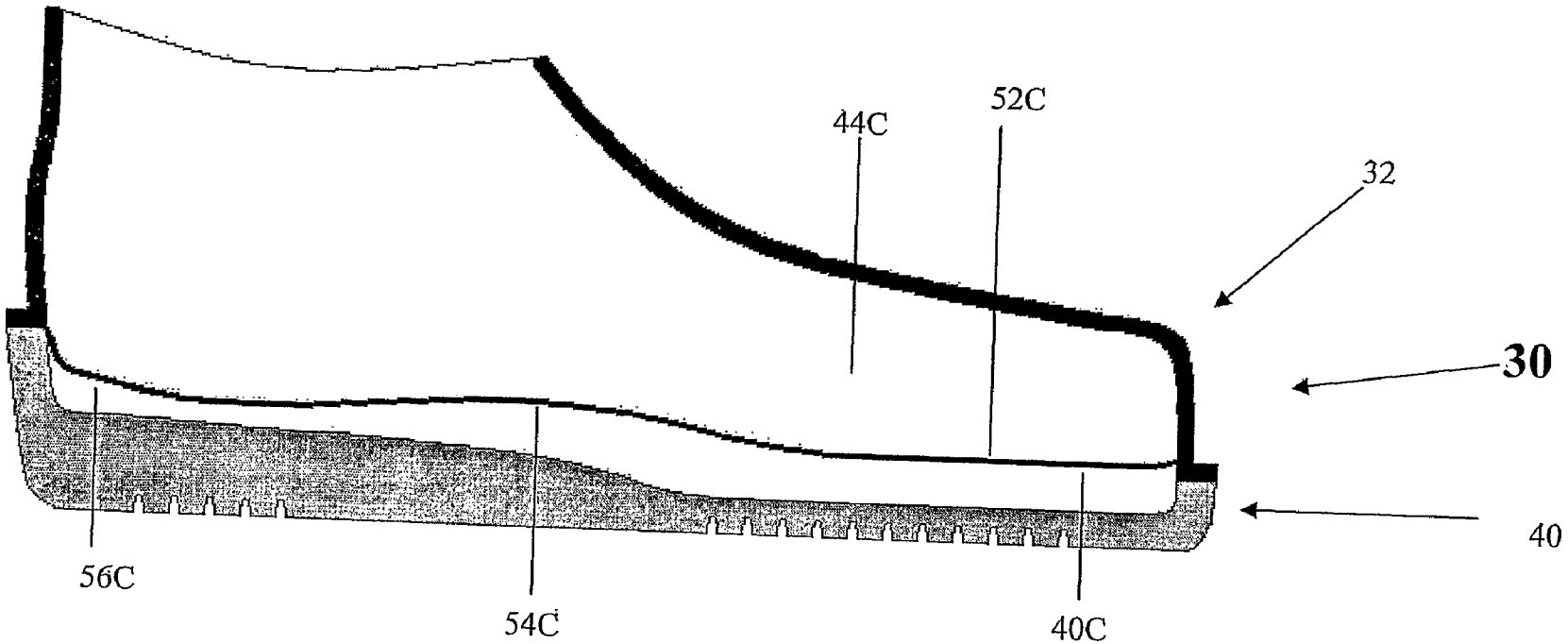

FIG. 6C schematically illustrates shoe 32 fitted with adapter 40C, having a raised forefoot section, so as to be thicker than adapter 40B, thus providing shoe 32 with the final inner volume 44C, which is smaller than the final inner volume 44B. This Figure illustrates the raised forefoot section 52C, an arch section 54C, and a heel section 56C, of adapter-insole 40C. Again, in accordance with an embodiment of the present invention, the topographies of adapters 40C and 40B differ primarily at the forefoot sections 52C and 52B, while the heel sections 56C and 56B may be nearly the same. The arch section 54C is shaped to provide continuity between the heel and forefoot sections. The situation of FIG. 6C is applicable, for example, in cases in which shoe 32 fitted with a standard insole would be too loose. Again, other topographies are similarly possible and will be apparent to those skilled in the art.

Figure 6D:
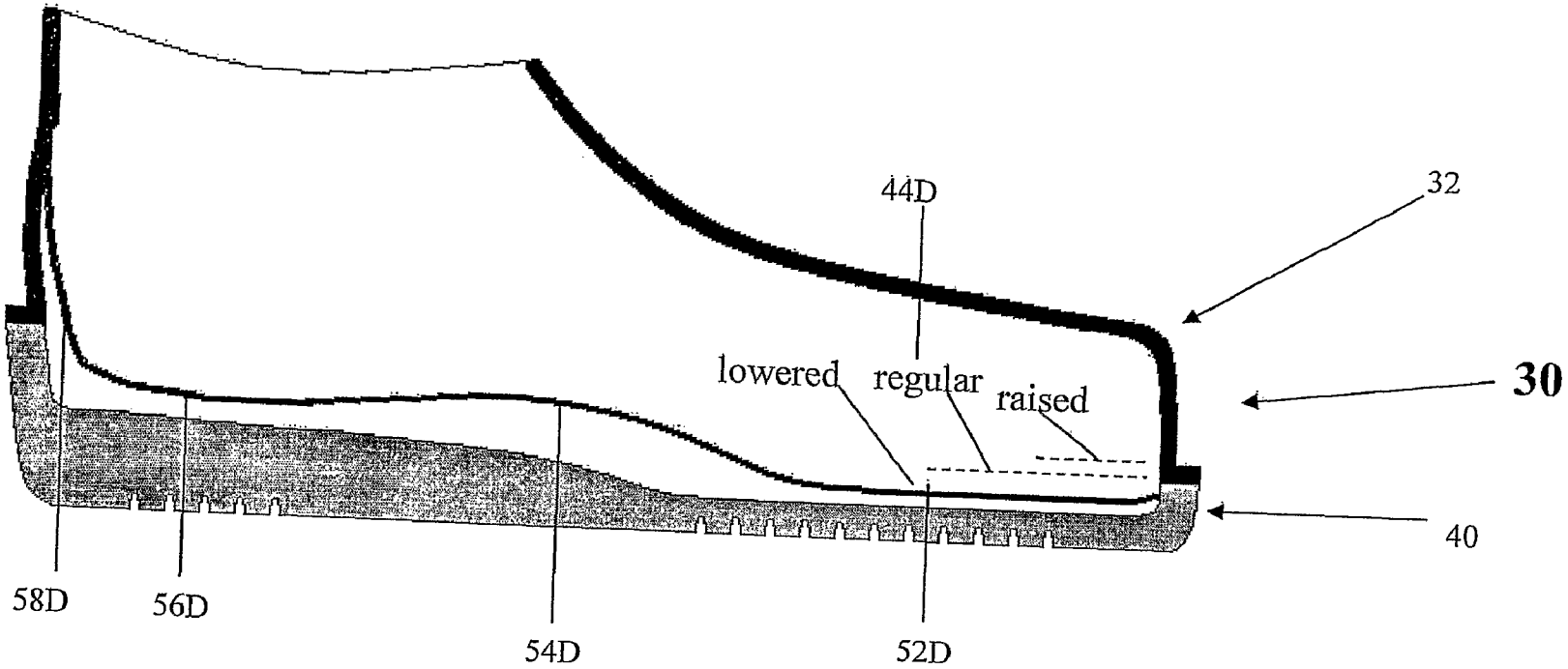

FIG. 6D schematically illustrates shoe 32 fitted with an alternative adapter 40D, which comprises a heel-back-support section 58D, for pushing an arch section 54D towards a forefoot section 52D. Forefoot section 52D has three possible forefoot sections: a raised forefoot section, a lowered forefoot section, and a standard, or regular forefoot section. The heel-back-support section 58D is generally needed when a shoe 32 is one or two sizes too large, vis a vis the foot. The lowered forefoot section of FIG. 6D would be selected when the foot outline is too wide when compared to the specific last bottom. The regular forefoot section of FIG. 6D would be selected when the foot outline fits within the specific last bottom outline. The raised forefoot section of FIG. 6D would be selected when the foot outline is too narrow when compared to the specific last bottom. It will be appreciated that the heel-back-support section 58D may be integrated with the adapter, or provided as a separate piece inserted to the adapter.

As has been pointed out in conjunction with FIGS. 2D-2G above, the last bottom outlines 20 increase in width with increasing shoe size. Thus, when a wide shoe 32 is required, rather than manufacturing the shoe 32 of the required extra width, one can use the mass-produced shoe 32 of a larger length. However, there are two problems with this approach:

i When an extra width is required, at a certain area, for example, the ball area, of the foot, (See FIG. 1 points B, F and E), providing a shoe of a larger length, so as to have the necessary width at the ball area, will not solve the problem. The shorter foot will have its ball area at the lower area of the shoe, and will not benefit from the added width, which is provided for it.

ii Furthermore, the shorter foot will have its arch placed wrong with respect to the shoe of the larger length because arch location is proportional to length of foot.

In accordance with an embodiment of the present invention, adapter 40D is designed to solve these two problems by providing heel-back-support section 58D, which pushes the foot forward towards the forefoot section, and ensures that the arch is properly placed within the shoe 32.

The situation of FIG. 6D is applicable for cases of a wide foot in a shoe larger than one size where the shoe 32 with adapter 40A would still be too tight. In such cases, generally, the forefoot section 52D would be similar to that of 52A, that is, thinner than that of 52B, for providing the added final volume 44.

Additionally, the situation of FIG. 6D is applicable for cases where the larger shoe is selected for the longer foot, while the other foot does not require the extra length. In such cases the forefoot section 52D may be similar to that of 52B, or even 52C.

Another example for the use of adapter 40D is for children whose feet grow rather fast. In such cases, the forefoot section 52D would probably be similar to that of 52C, since the larger size shoe 32 would provide considerable excess width.

Figures 7A, 7B, 7C, 7D:
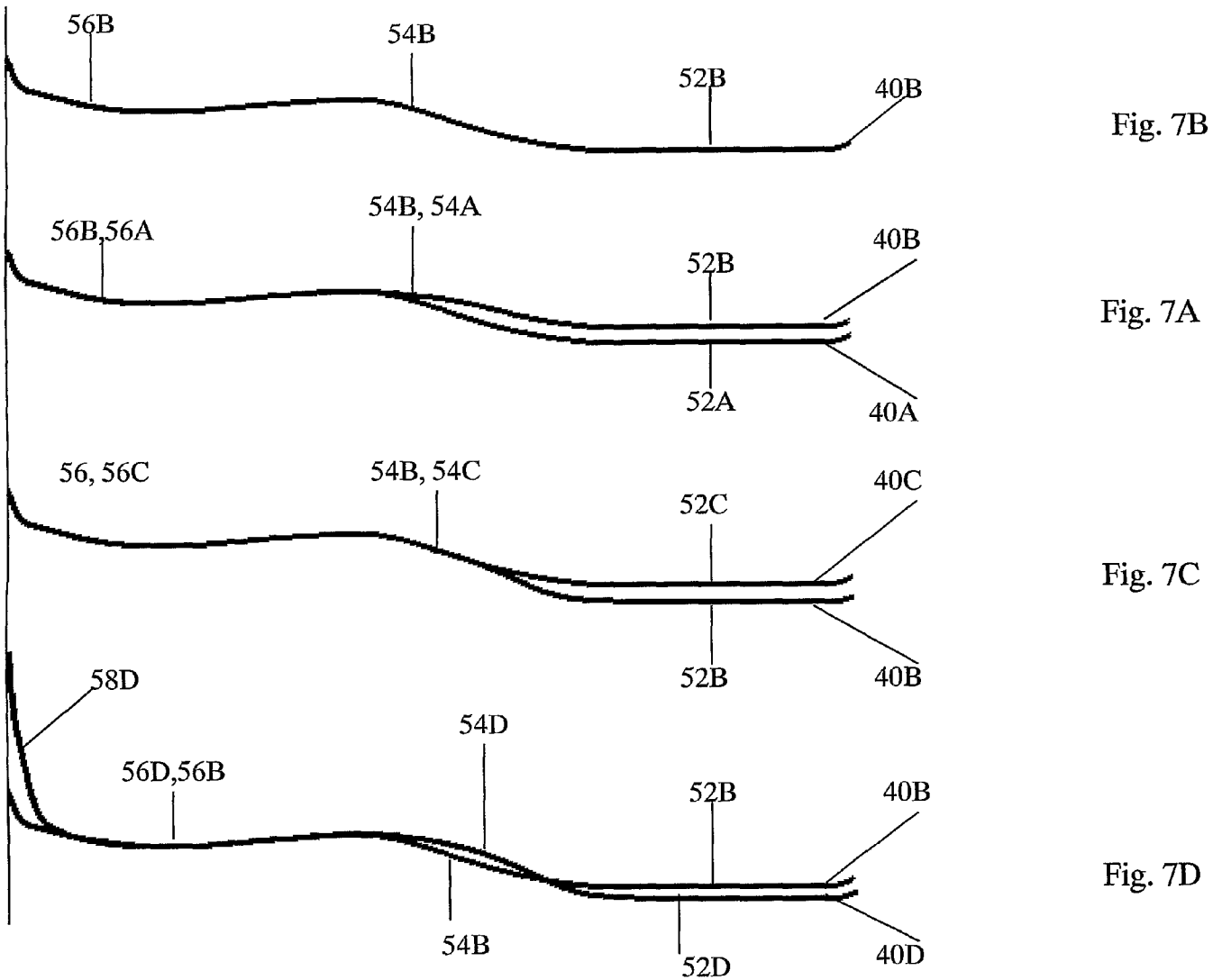
FIGS. 7A-7D are diagrams that schematically illustrate adapter length profiles, in accordance with embodiments of the present invention.

FIGS. 7A-7D illustrates different topographies of adapters 40A-40D, in accordance with an embodiment of the present invention. Thus:

i. As seen in FIG. 7B, adapter 40B is substantially a standard regular insole.

ii. As seen in FIG. 7C, adapter 40C has a raised forefoot section 52C, when compared to the forefoot section 52B, for providing the reduced final volume 44C (FIG. 5C).

iii. As seen in FIG. 7A, adapter 40A has a lowered forefoot section 52A, when compared to the forefoot section 52B, for providing the greater final volume 44A (FIG. 5A).

iv. As seen in FIG. 7D, adapter 40D comprises the heel-back-support section 58D, designed for pushing the foot forward towards the forefoot section, thus correcting for the position of the overall foot and specifically, the arch, within shoe 32.

It will be appreciated that the mass-produced unfilled shoe 32 is provided in left and right shapes, and in a plurality of sizes. While it is generally accepted that the selected right and left mass-produced shoes 32 will be of a same volume, it is not required that the right and left adapters 40 will be of the same topography. On the contrary, adapters 40 are typically selected and provided individually for each foot, so as to optimize the fit on each foot. Naturally, a single shoe size is desirable, to match the last bottom outlines of shoes 32, but a right adapter 40 may comprise, for example, adapter 40C, and the left adapter 40 may comprise, for example, adapter 40A.

Additionally, there may be a great variety of designs of mass-produced (unfinished) shoes 32, each design defining a specific last-bottom outline for each size, and each design including a plurality of sizes.

Preferably, the adapter-insoles 40A, 40B, 40C, 40D, and such are color-coded. For in this manner a storekeeper may identify a required adapter-insole easily and customer can see the changes easily.

Table 1 below, which is generally known in the industry, describes a relationship between shoe length size and Ball girth (FIG. 2A). The table below is part from completed table based on the EU standard, but it will be appreciated that there are other standards, for example, US, GB, and Monde with similar length and widths.

| SHOE | Shoe Width | | | | |
|---|---|---|---|---|---|
| LENGTH | 5 | 6 | 7 | 8 | 9 |
| 39 | 22.3 | 22.8 | 23.3 | 23.8 | 24.3 |
| 40 | 22.7 | 23.2 | 23.7 | 24.2 | 24.7 |
| 41 | 23.1 | 23.6 | 24.1 | 24.6 | 25.1 |

The difference in Ball girth, between adjacent shoe width sizes, for example, between 5 and 6, is 0.5 centimeters (for example, 22.8-22.3), while the difference in Ball girth between adjacent shoe length sizes is 0.4 centimeters (for example, shoe sizes 39 to 40 the difference in Ball girth is 22.7-22.3).

Figure 7F:
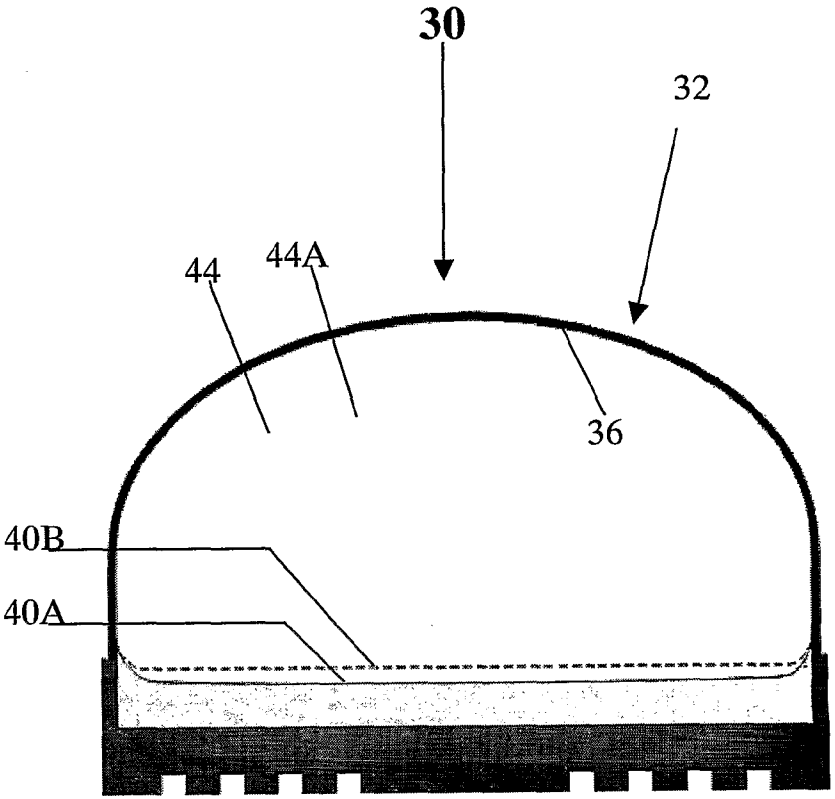
FIGS. 7E and 7F are diagrams that schematically illustrate cross-sections of shoes fitted with different thickness insole adapters, in accordance with embodiments of the present invention.
Figure 7E:
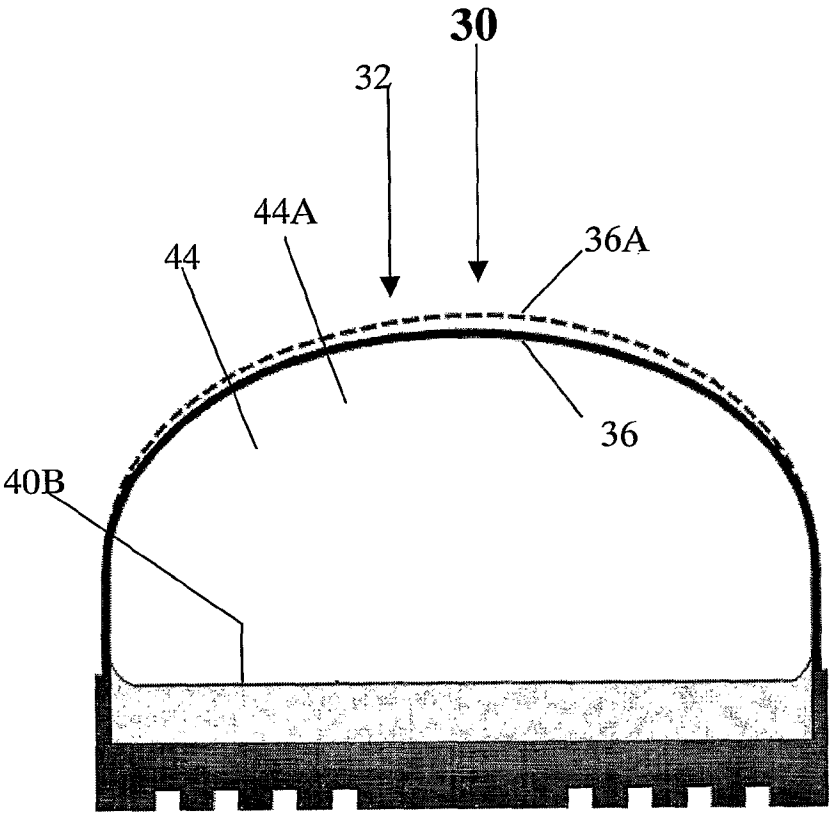

FIG. 7E schematically illustrates a cross-sectional view of a shoe and adapter system 30, showing a change in Ball girth as one moves from one shoe width size to an adjacent shoe width size, for example, from width size 5 to 6. Accordingly, for the smaller width size 5, the shoe Ball girth is shown by the line 36, together with adapter-insole 40B defining the inner volume 44; and for the larger width size 6, the shoe Ball girth is shown by a line 36A, defining a corresponding inner volume 44A.

FIG. 7F schematically illustrates a similar change in inner volume, achieved by the adapter height, in accordance with an embodiment of the present invention. Accordingly, volume 44 may be achieved by shoe upper 36 with the adapter-insole 40B. Yet volume 44A may be achieved by the same shoe upper 36, but with the adapter-insole 40A.

In consequence, the change in inner volume, achieved by reducing the adapter height, for example, from 40C to 40B, or from 40B to 40A, resulting in an average change in adapter height of about 2.5 mm, may be equivalent to a change in girth of 5 mm or one full width size.(EU scale)

Thus, when shoe length size is increased, both the shoe length and the shoe width are increased. By comparison, when only the shoe width is increased, the length remains constant.

Shoe Fitting Apparatus Description

Figure 10A:
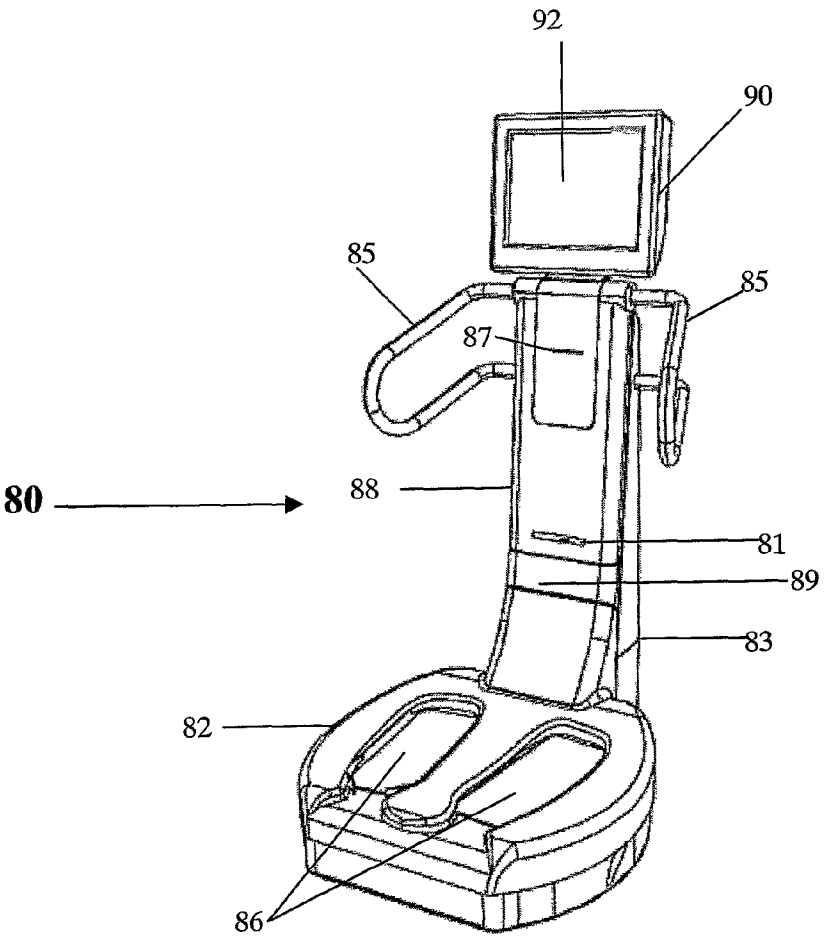
FIGS. 10A-10C are schematic, pictorial illustrations of an apparatus for automated shoe-fitting, in accordance with an embodiment of the present invention.
Figure 10B:
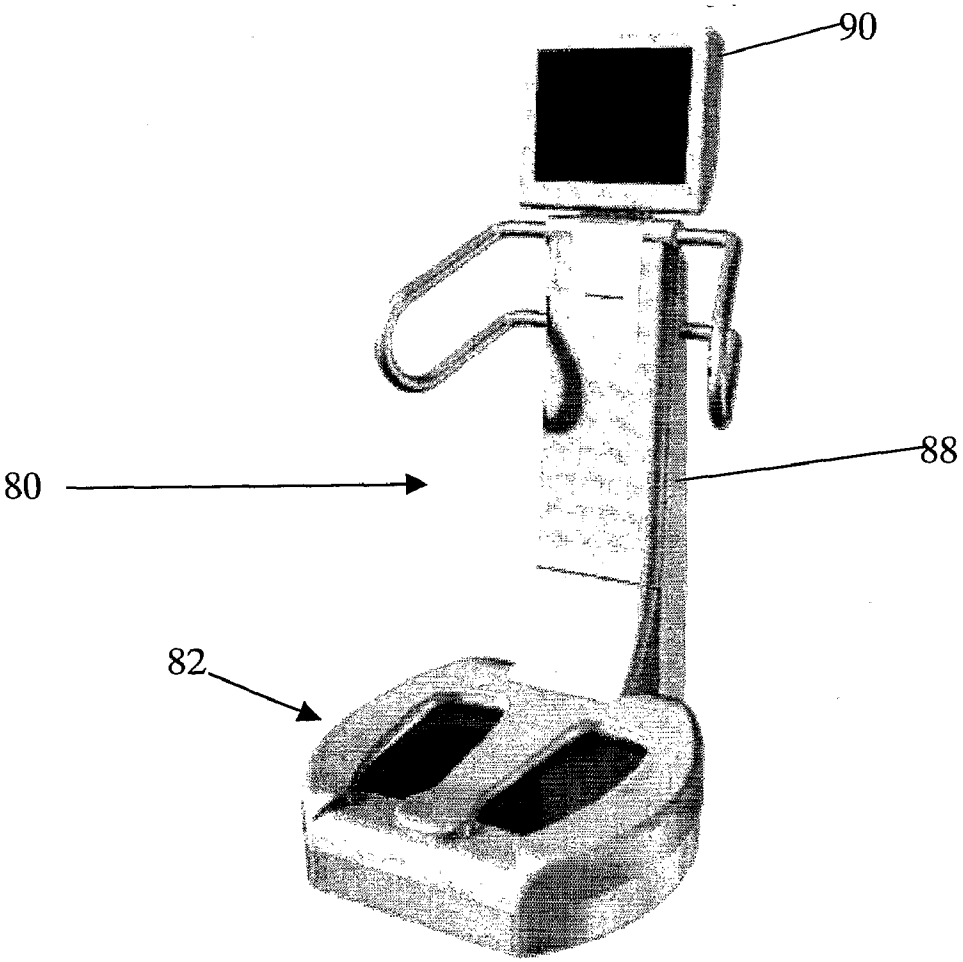
Figure 10C:
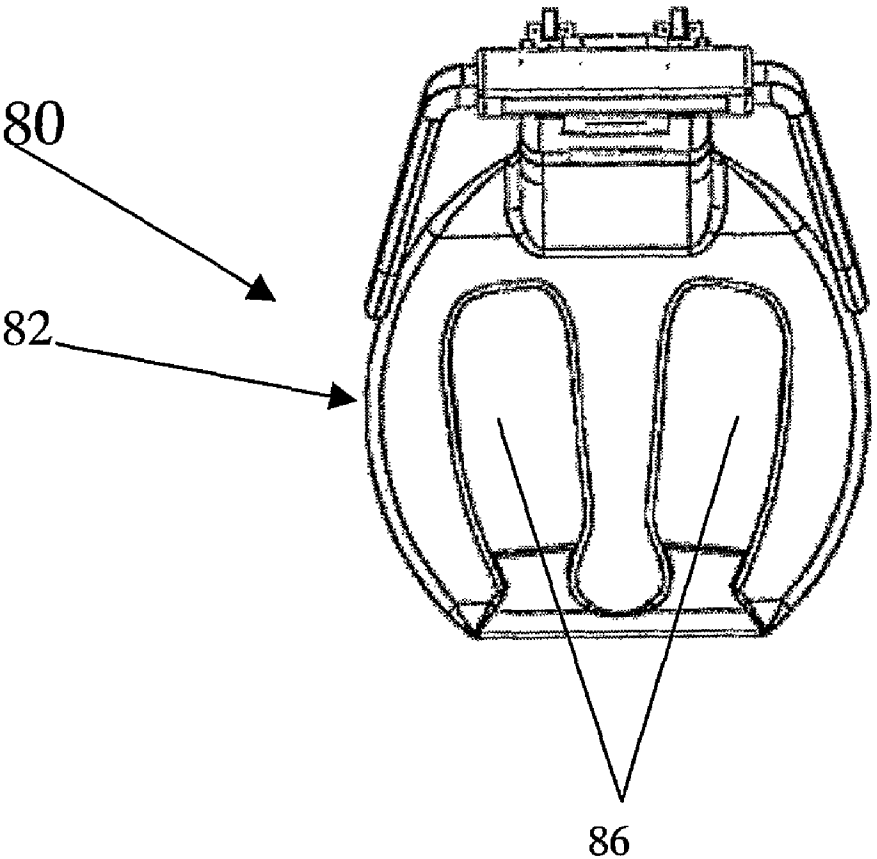

FIGS. 10A-10C schematically illustrate apparatus 80 for automated shoe fitting, in accordance with an embodiment of the present invention. Apparatus 80 comprises a base 82 comprising two platforms 86, one for each foot, on which human feet are placed for obtaining foot outlines. Platform 86 is substantially transparent in a near-infrared light range, for obtaining foot outlines 10 and 11 by near-infrared light reflection. In some embodiments, platform 86 is substantially opaque in the visible light range, for appearing black to the user, since stepping on a transparent platform may cause uneasiness. Platform 86 is substantially transparent in a near-infrared light range, for obtaining foot outlines 10 and 11 by near-infrared light reflection.

Platform 86 defines an x-y plane parallel with the platform, and a z-axis perpendicular to the platform.

The exemplary shoe-fitting apparatus shown in FIG. 10A may further comprise a support structure 88 comprising armrests 85, and a display 90, which may comprise a touch screen 92 that is further described herein below.

Figure 10D:
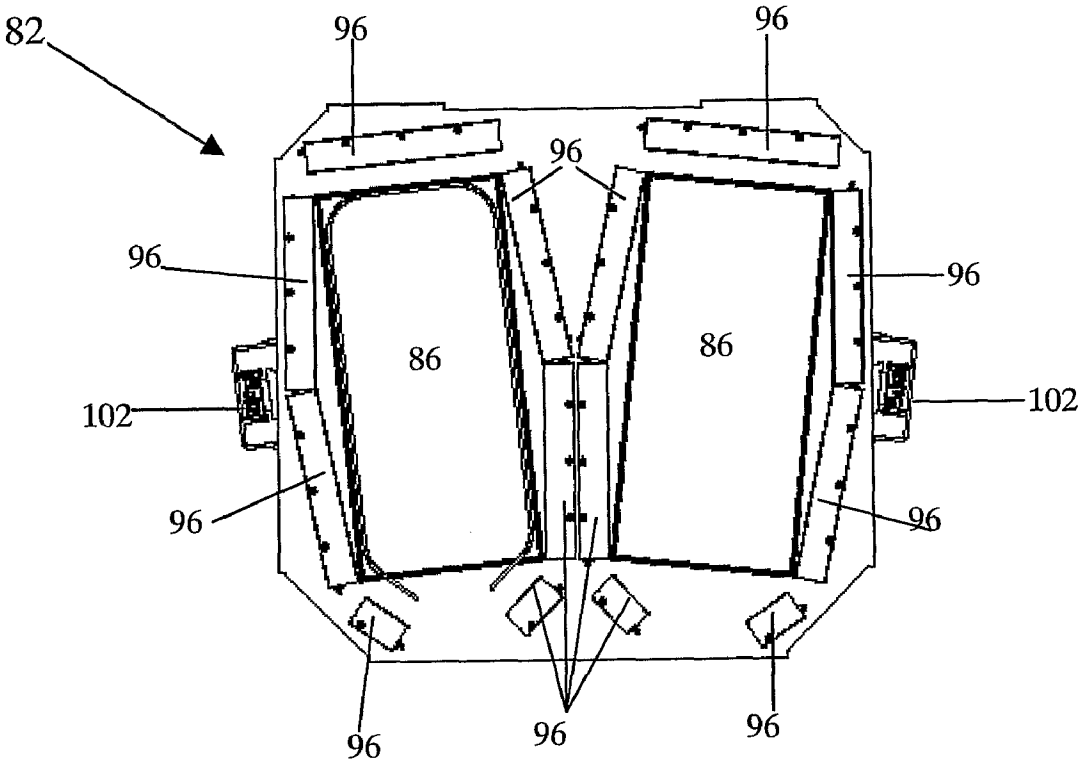
FIGS. 10D-10F are diagrams that schematically illustrate a bottom portion of the shoe-fitting apparatus of FIGS. 10A-10C, in accordance with an embodiment of the present invention.
Figure 10F:
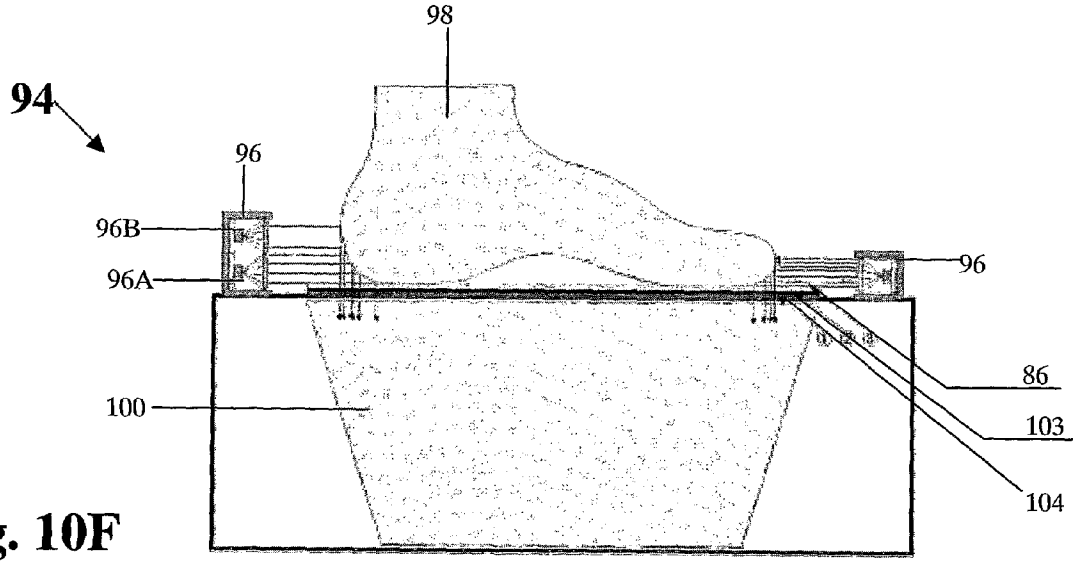
Figure 10E:
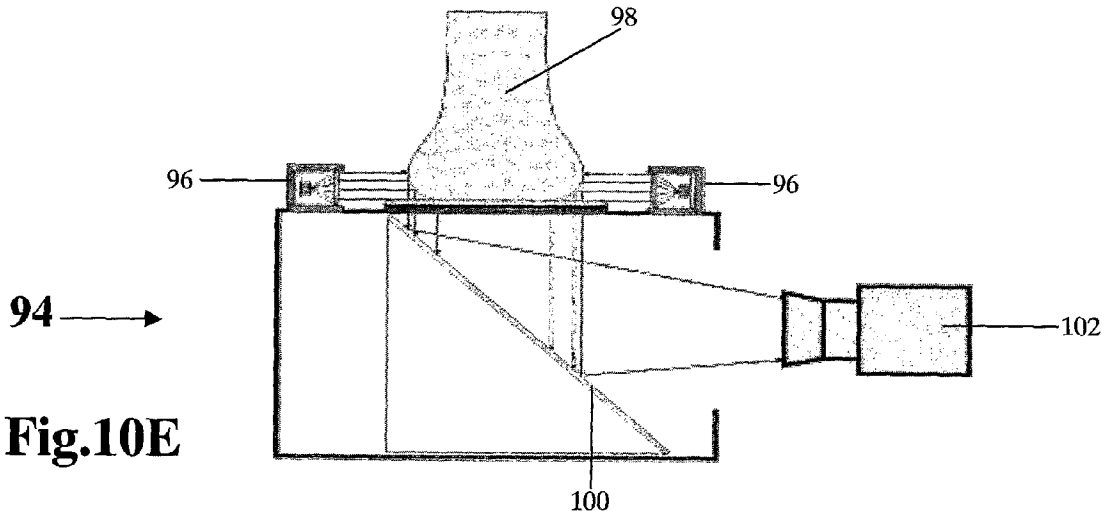

FIGS. 10D-10F schematically illustrate an optical system 94 fitted into base 82 of apparatus 80. Optical system 94 images the user's feet so as to obtain foot image 13, in accordance with an embodiment of the present invention.

Optical system 94 comprises a light source 96, which irradiates feet 98 with near-infrared light parallel to platform 86. In the exemplary embodiment of FIG. 10F, light source 96 comprises a plurality of light-emitting diodes (LEDs). Alternatively, any other suitable source of light may be used.

The top view shown in FIG. 10D illustrates a single row of light sources 96. In practice, however, two or more rows may be used. Additionally, some sections of feet 98 may be irradiated with a single layer of light sources, and others like toe and heel, with two or more layers. This is illustrated in FIGS. 10E and 10F, where the side and toe sections are irradiated with a single layer of light sources 96, but the heel section is irradiated with two layers 96A and 96B.

In some embodiments, as seen in FIGS. 10E and 10F the light emitted from the light sources 96 is collimated in the z direction. The optical system comprises a mirror 100, on a distal side of the platform 86, for bending a light reflection from the feet 98 and directing the light reflection to a light detecting system 102. The light detecting system 102 may comprise, for example, a complementary metal oxide semiconductor (CMOS) camera, a charge coupled device (CCD) camera, or any other suitable device capable of detecting near infra red light.

In some embodiments, a Fresnel lens 104, as is known in the art, may be located below filter 103 in order to collimate the light reflected from feet 98. The collimation by the lens 104 typically makes the optical system less sensitive to the exact position of feet 98 on platform 86.

The use of filter 103 and near infrared light sources 96, rather than visible light sources, results in less interference from ambient light in the room reaching light detecting system 102. Placing filter 103 directly below glass platform 86 has the potential advantage that it can prevent the user from seeing through glass platform 86, assuming filter 103 largely blocks visible light and only transmits light in the near infrared.

Being able to see through glass platform is likely to make the customer uneasy about standing on it. The ability to use a filter 103 that appears black to the eye is another potential advantage of using near infrared light sources.

Apparatus 80 further comprises a fitting processor 83, which processes the image captured by optical system 94 and carries out the automated fitting methods described herein. In particular, processor 83 identifies the inner and outer foot contours and uses them to select a best-matching insole adapter.

Figure 11A:
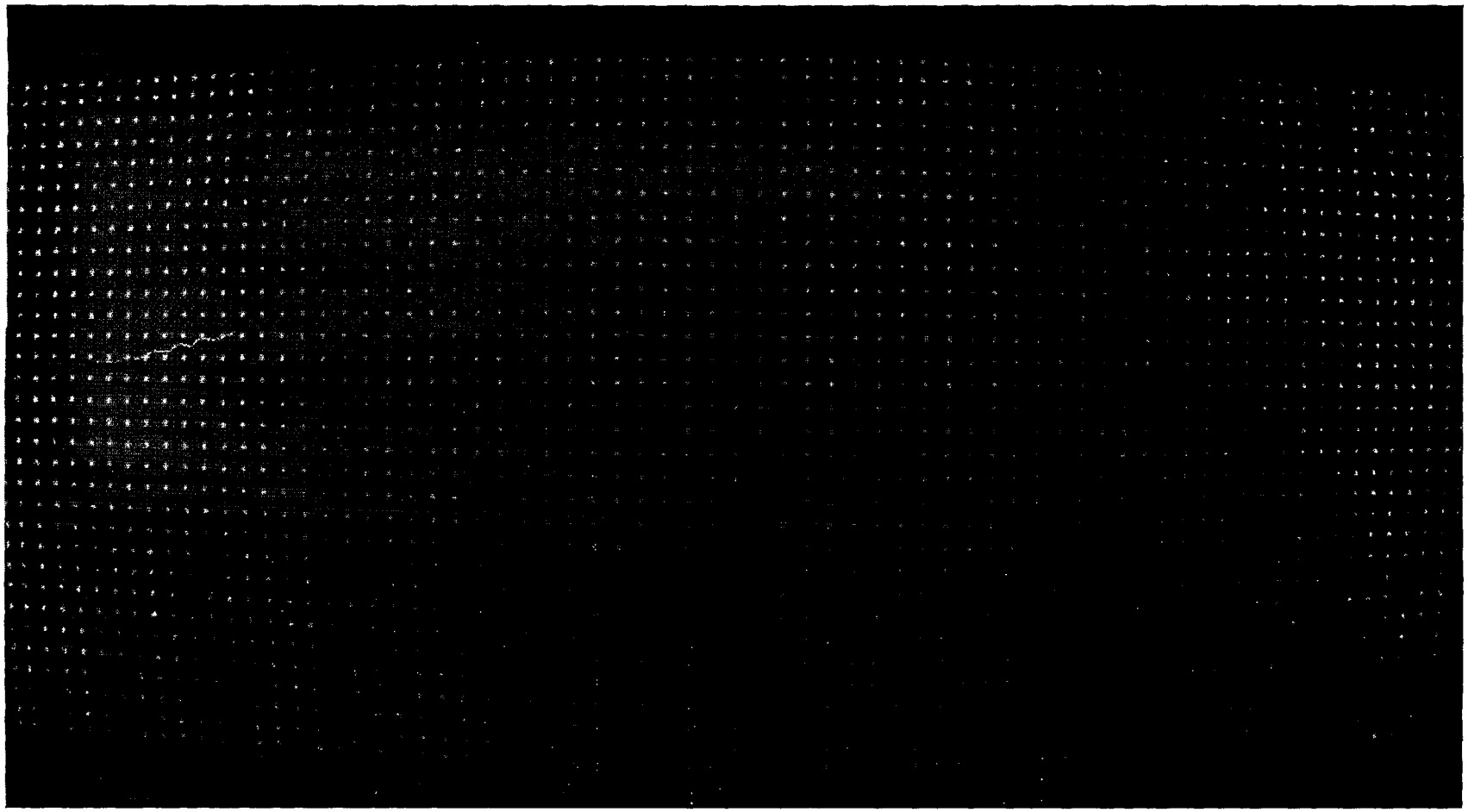
FIG. 11A is a diagram that schematically illustrates a barreled grid for correction of distortion, in accordance with an embodiment of the present invention.

FIG. 11A schematically illustrates the effect of radial distortion in wide angle lens, sometimes referred to as a "barrel effect." This effect may distort the acquired foot outlines. Radial distortion can be corrected by capturing an image by camera 102 (FIG. 10E) using a grid of precisely-spaced lines or dots on platform 86 as shown.

Figure 11B:
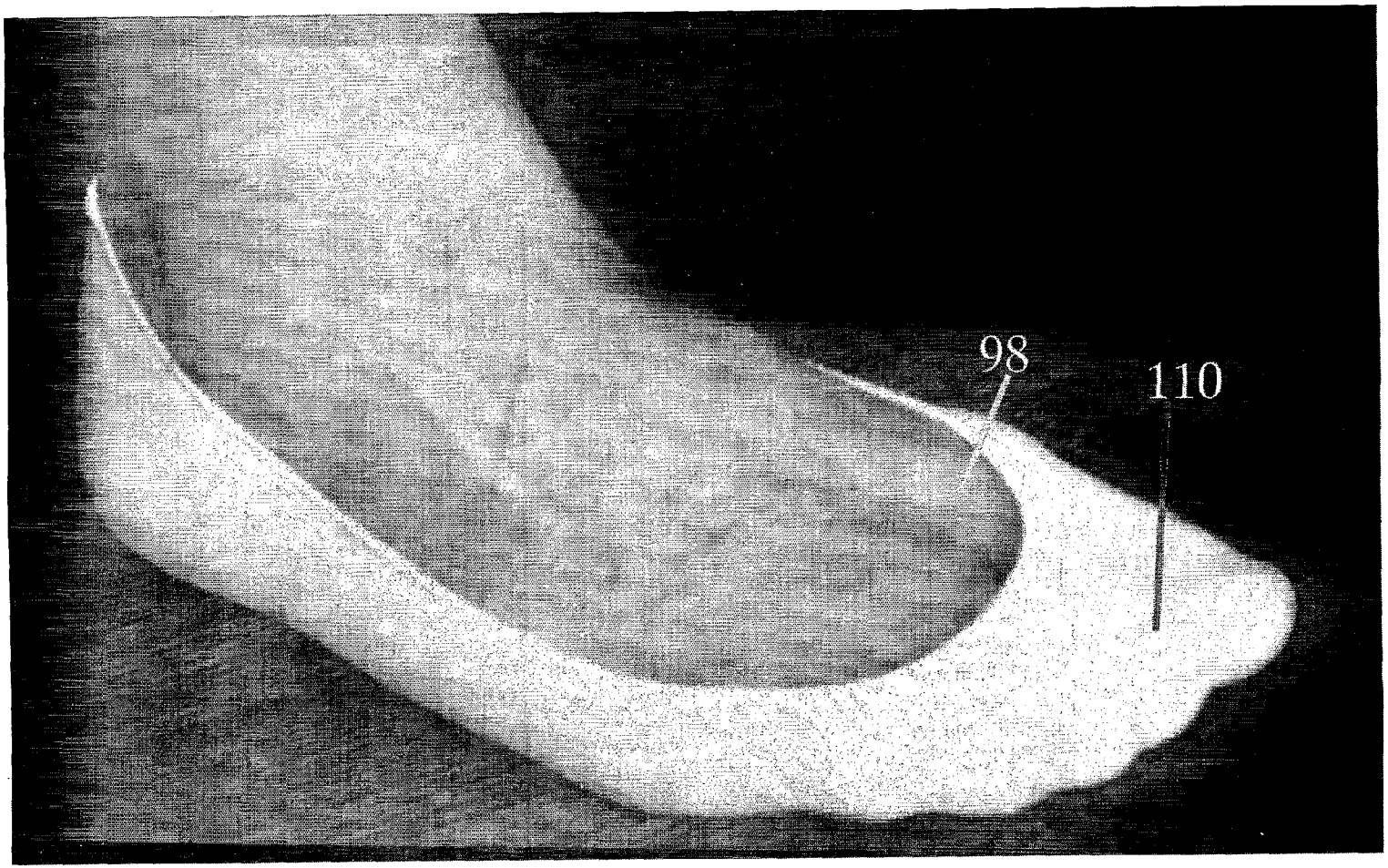
FIG. 11B is a pictorial illustration of a sock used for shoe fitting, in accordance with an embodiment of the present invention.

FIG. 11B schematically illustrates the wearing of a sock 110 for shoe fitting. Socks 110 may be provided to customers to wear on their feet before standing on apparatus 80. Socks have substantially uniform and diffuse reflectivity at NIR wavelengths. Socks serve to hold the user toes together, nearly as they will be held when wearing shoes. In addition, the socks keep the surface that the customer stands on hygienic.

Figure 12:
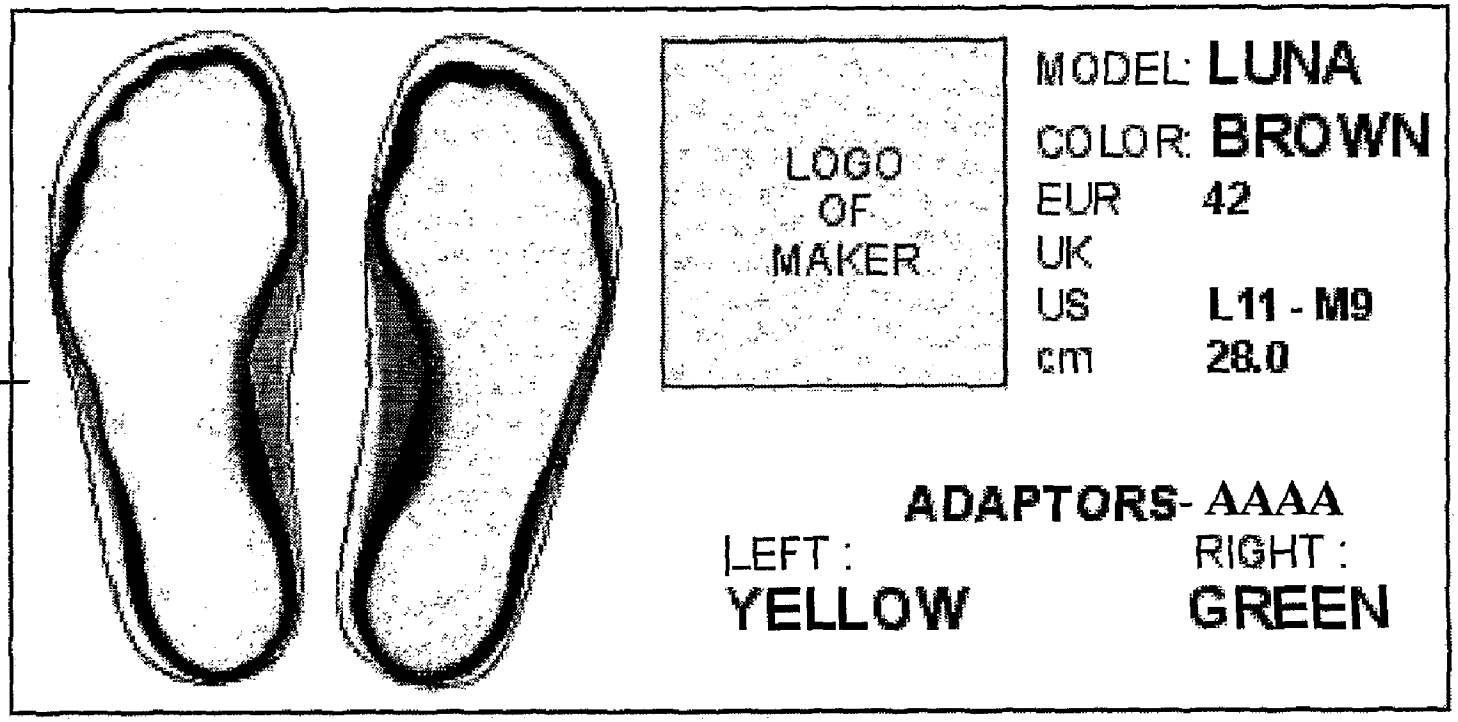
FIG. 12 schematically illustrates an exemplary printout printed by the shoe-fitting apparatus of FIGS. 10A-10C, in accordance with an embodiment of the present invention.

FIG. 12 schematically illustrates a printout 115 printed by the printer 87 of shoe-fitting apparatus FIG. 10A. A printout 115 shows the results of adapting process, helps the salesperson to remember the type of shoe required, the manufacturer's name, the shoe size, adapter-insole type and adapter-insoles color code for each foot. The customer receives the printout 115 in end of process, helps to preserve the experience of the fitting in the store.

FIGS. 13A-13F schematically illustrate the screens shown in user-interface touch screen 92, used in the various stages of the fitting process and also serves as an interface through which instructions are passed to the apparatus.

Figure 13A:
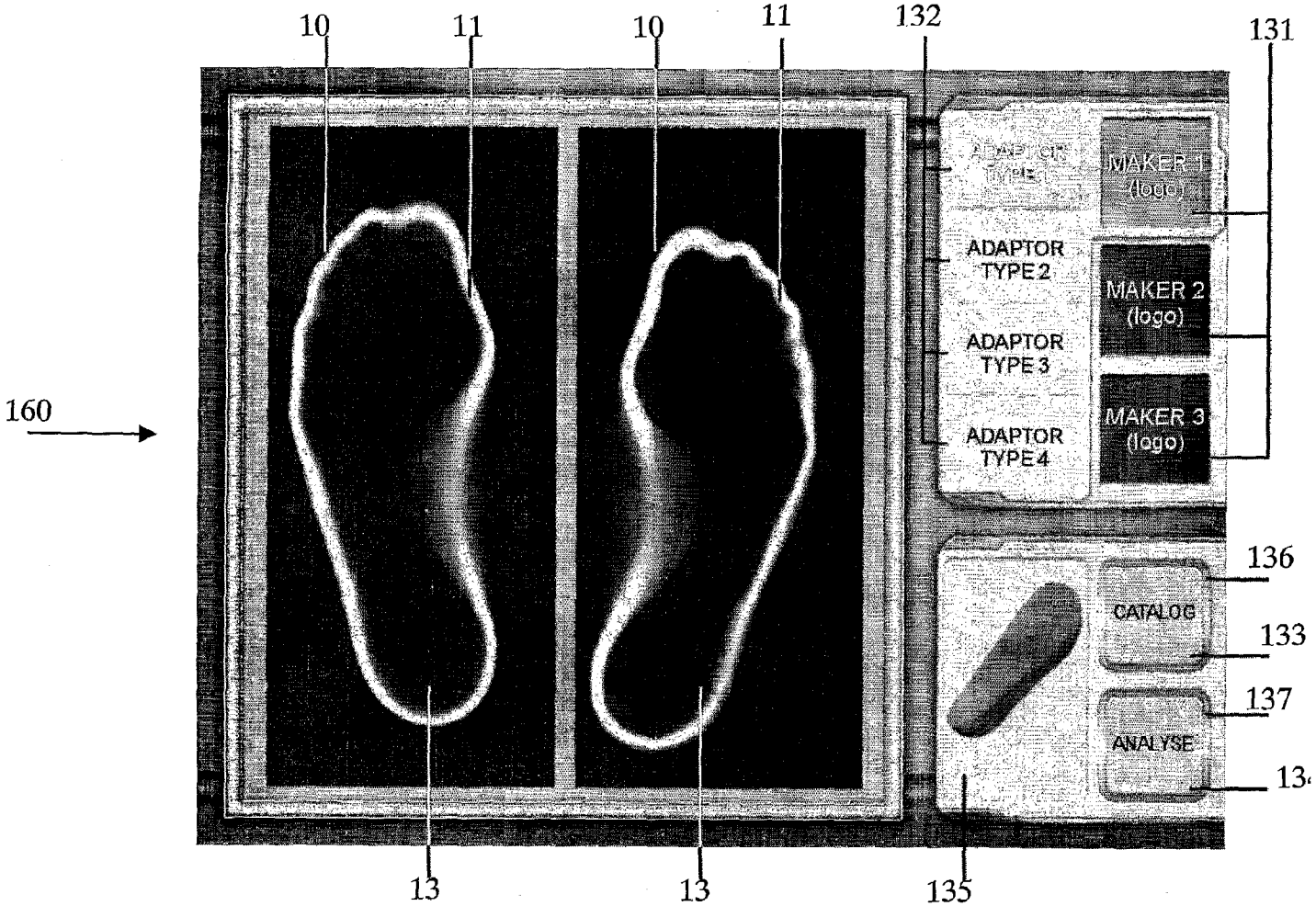
FIGS. 13A-13C schematically illustrate exemplary screen displays during an initial fitting process of the shoe-fitting apparatus of FIGS. 10A-10C, in accordance with an embodiment the present invention.

As seen in FIG. 13A, screen 160 is displayed when the device is turned on. It is also the main menu screen. The Maker buttons 131 display the logos of the shoe manufacturer. The data bank 89 (FIG. 10A) contains the information required for fittings and display of the shoe manufacturer. Pressing one of the Maker buttons 131 displays the adapter types 132 according to that manufacturer's bottom last outlines 20 (insole pattern). The name of the adapter is printed on every shoe in the store next to the name of the shoe model.

The salesperson in the store presses the appropriate adapter button 132 according to the shoe chosen by the customer in the display. From that point on, the selected adapter serves as the basis for the fitting process.

The adapter selected to achieve a fitting is displayed in an enlarged three-dimensional image 135. It is important to note that one adapter type may serve several sole models and many shoe models in different colors and of different designs, so that the number of adapter types kept in stock in the store is not necessarily as large as it would initially seem. Immediately upon standing on apparatus 80, both feet 89 are displayed in a video stream of foot images 13.

The foot image 13 (FIGS. 3A, 3B) seen on the screen is the reflection of light from light source 96 which is projected around the soles of each foot 98 (FIGS. 10E-10F) of the person being measured. The fitting between the foot and the adapter is effectively made in the illuminated area. As shown in FIGS. 3A, 3B, the inner dark colored part of each foot pressing against platforms 86, bounded by inner outline 11, does not reflect light towards the camera 102. The part of the foot 89 projecting above the platform 86 in the Z axis is bounded by the outer outline 10.

The person being measured sees that changing the positioning his feet on the platform and wiggling his toes are displayed on the screen.

The Analyze button 134 (FIGS. 13A-13C) is used to start the fitting for the last captured and approved feet outlines in relation to the selected adapter-insole type. The Analyze button 134 is only enabled when the inner 11 and outer 10 outlines on both feet have successfully passed tests like a continuity that prevents entry into the fitting mode if the big toes are raised for example or an attempt is made to measure an object that is not defined as a foot. When the Analyze mode is enabled, the frame 137 around the Analyze button 134 is illuminated.

Figure 13B:
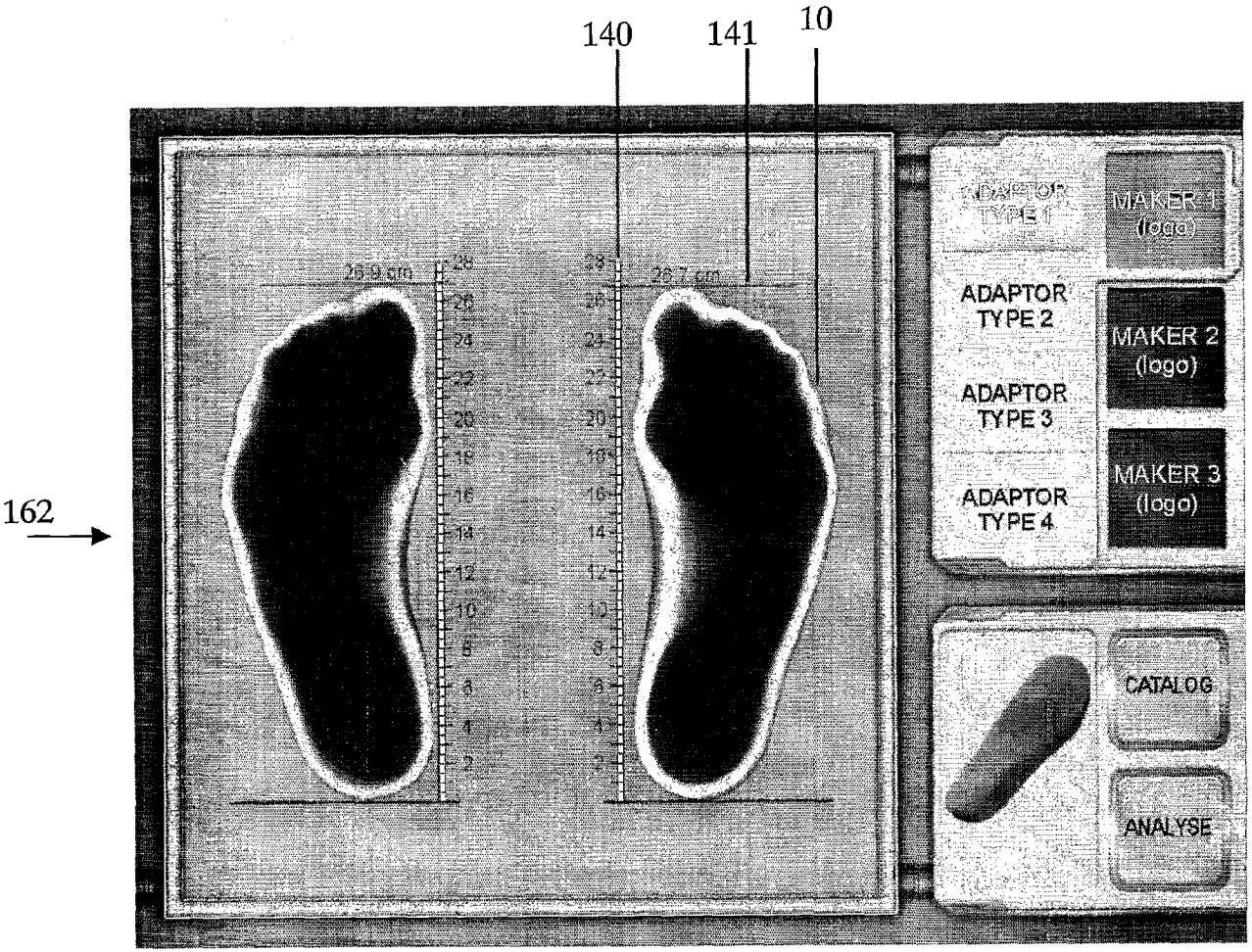

Screen 162 in FIG. 13B displays one of the options for measuring the length of the foot. Several measurements can be combined: foot length, foot width and heel to ball-of-foot measurement. This screen is used primarily to compare between a conventional fitting process that is based only on two or three measurements, and between a fitting process in accordance with the methods described herein, which is based on the inner and outer outlines of each foot, plus the last bottom outline 20 (insole pattern) of the specific shoe.

A scale 140 (e.g., metric or inch) can be selected. Measurement 141 shows the maximum length, measured at the outer outline 10.

Figure 13C:
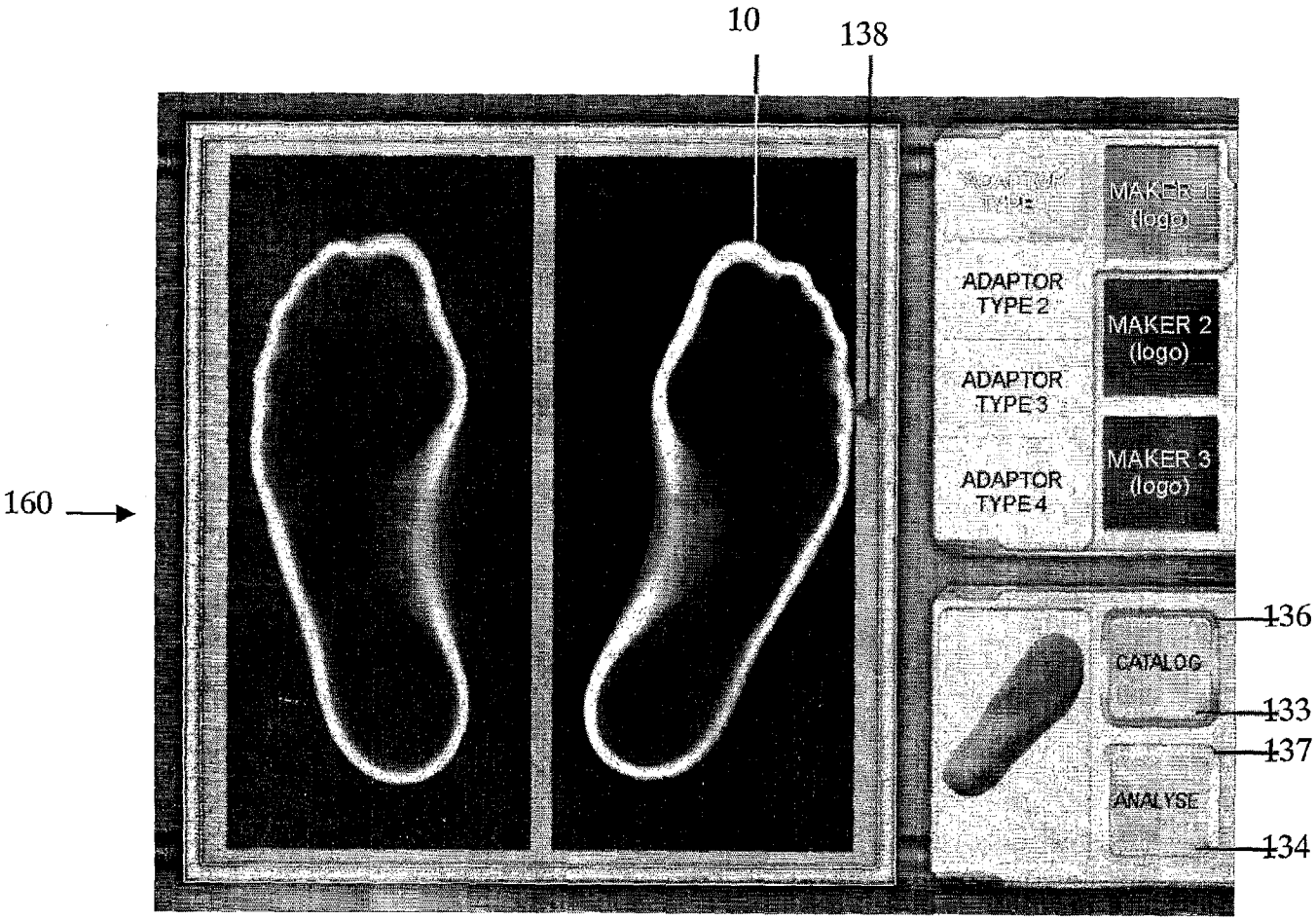

Screen 160 in FIG. 13C shows the right foot touching the edge of platform 86 at the point marked 138, thus interrupting the outer outline 10. Text or an icon (in the form of an arrow or finger, for example) marks the location of the error and enables quick identification and correction of the foot position.

In the above case, the Analyze button 134 is disabled; the frame around the button 137 is not illuminated.

Figure 13D:
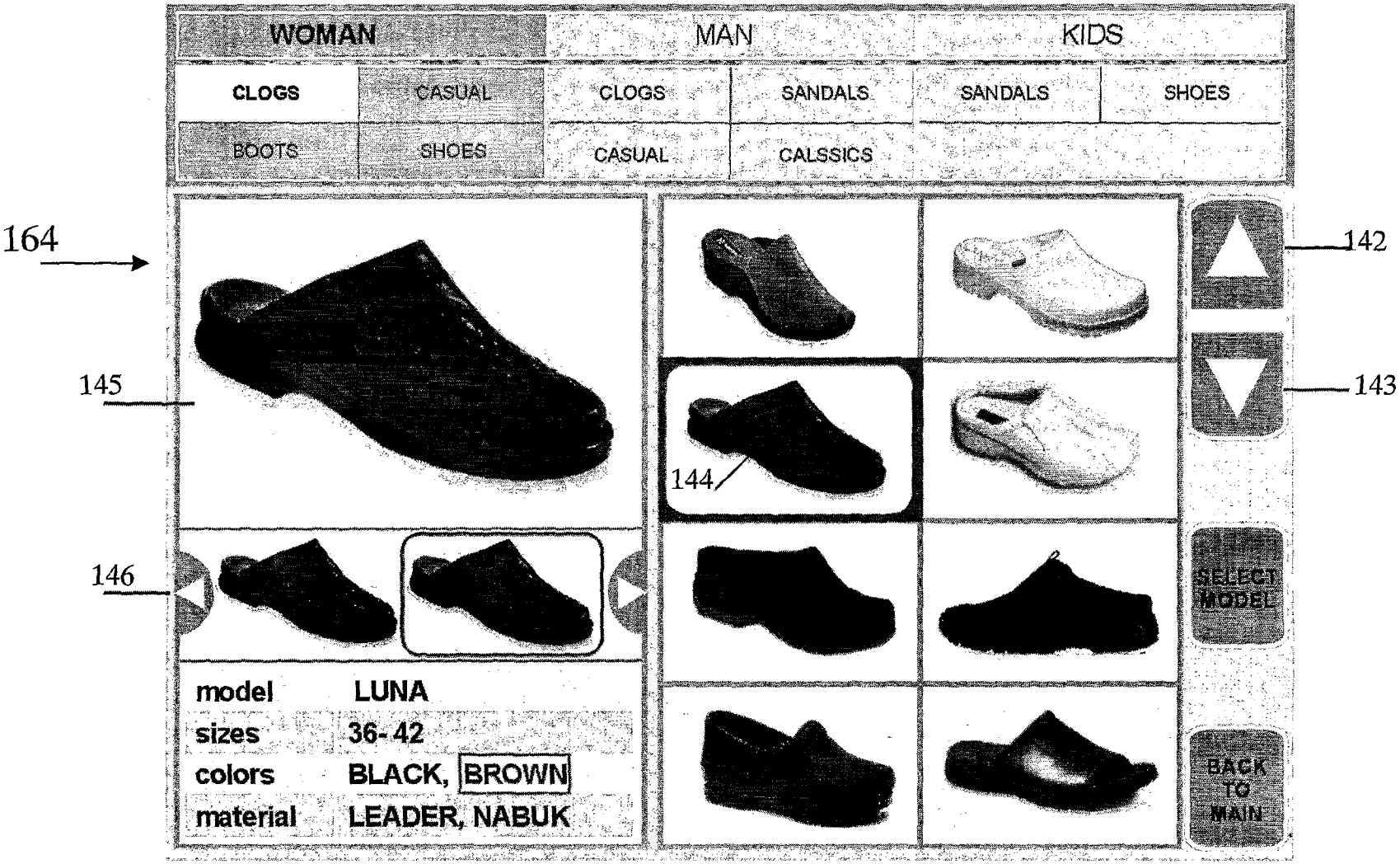
FIG. 13D schematically illustrates an exemplary screen display of a shoe catalog, associated with the shoe-fitting apparatus of FIGS. 10A-10C, in accordance with an embodiment of the present invention.

The screen shown in FIG. 13D applies when a customer in the store has not chosen a specific model from the main screen (FIG. 13A) and button 133 pressed. The catalog displayed depends on the maker that was selected before by pressing one of the Maker buttons 131 in FIG. 13A.

At the top of the screen in FIG. 13D, one can choose the customer gender and the shoe type (boots, clogs, etc.). Pressing on a shoe image 144, displays that shoe in the large image 145. All the colors in which the selected shoe is available are displayed in window marked 146. One can browse through them. The selected color is shown in window 145 and its details are displayed beneath window 146.

Browse backwards by pressing the up arrow button 142, and forwards by pressing the down arrow button 143. To return to the main menu by pressing the "Back to Main" button at the bottom right. Selecting a specific model defines the shoe manufacturer last bottom outline and the specific adapter-insole type. Back in the main menu 13A, the adapter-insole type for the selected shoe is illuminated. This outline is used as the reference outline for all fittings. The results of the fitting and the catalog information that appear in the printout 115 (FIG. 12) are based on this selection.

Figure 13E:
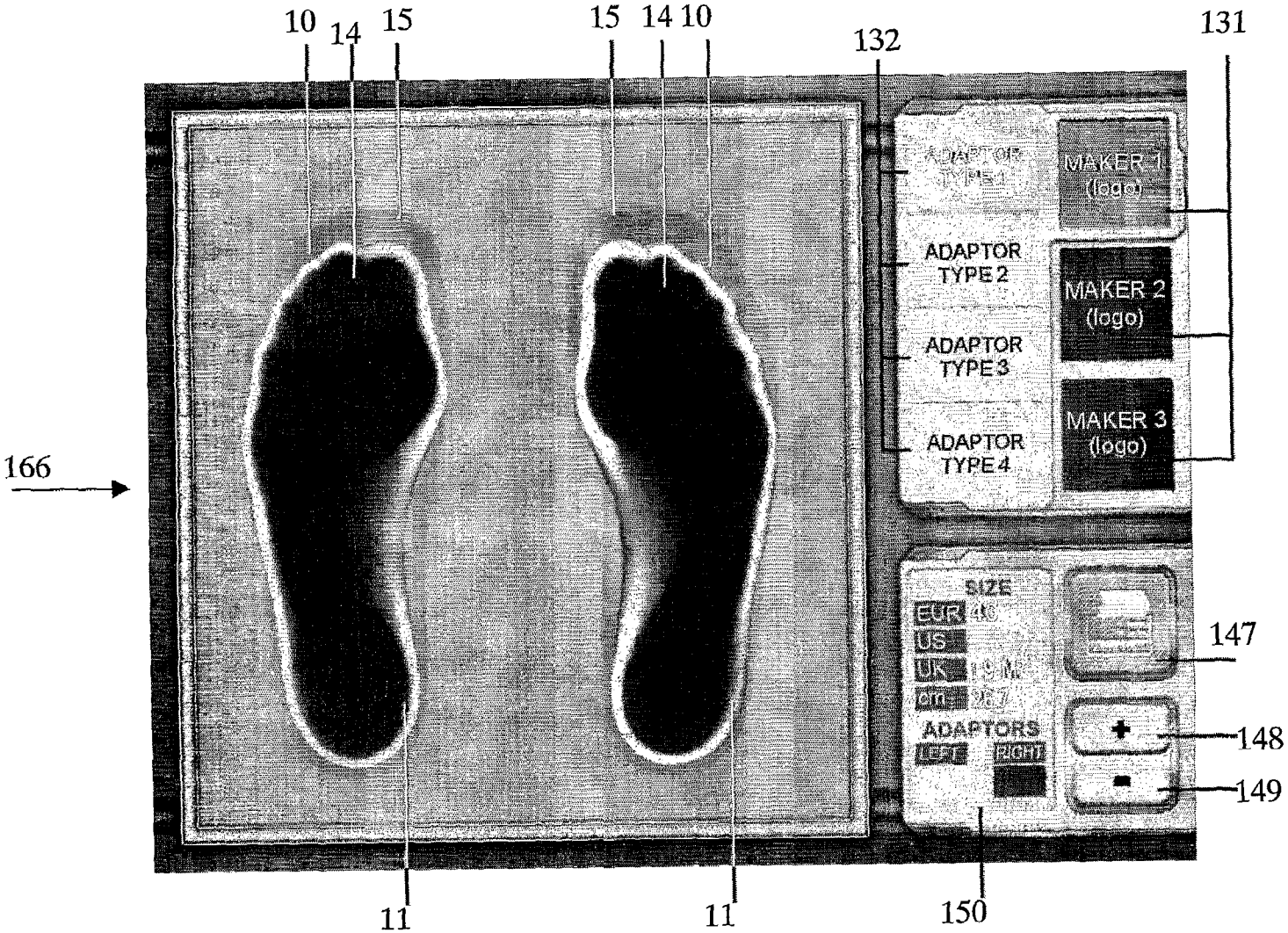
FIGS. 13E and 13F are schematic illustrations of the fitting process in three dimensions, in accordance with an embodiment of the present invention.

The screen in FIG. 13E displays when the Analyze button is pressed. This process is entered after the last feet outlines measured have passed all the verification tests. At this stage, the display becomes 3-dimensional FIG. 13F.

The foot image 13 becomes a three-dimensional model 14 based on the same outer outlines 10 and inner outlines 11. The three-dimensional image of adapter-insoles 15 selected for each foot in the process described in FIGS. 8A to 8C which are displayed to visualize the fitting. The person being measured can see clearly how her/his feet are positioned and fitted with the selected adapters 15 as if the top of the shoe has been peeled away. The measurement results are listed in the panel 150 and include the size of the selected shoe according to all size conventions as well as the adapter-insoles found suitable for the fitting between each customer foot and the shoe selected from the shoe manufacturer list 131 and the adapter type 132. The desired adapters appear in color for easy identification.

Printer button 147 sends the fitting results to the printer 87 (FIG. 10A). A printout 115 (FIG. 12) of the results helps the salesperson to remember the type of shoe required, the manufacturer's name, the shoe size and the adapter-insole type and adapter-insole color code for each foot. The customer measured receives the printout 115, helps to preserve the experience of the fitting in the store.

The "+" button 148 artificially increments the shoe size by one and makes an optimal fitting for each foot at the larger shoe size, naturally, when the results of the fitting permit this. This type of fitting is suited to teenagers going through a growth spurt. In this case, the customer receives two sets of adapters: one set to fit the feet as they are today in the incremented shoe size; and the other set for the size of each foot is enlarged proportionally.

Figure 13F:
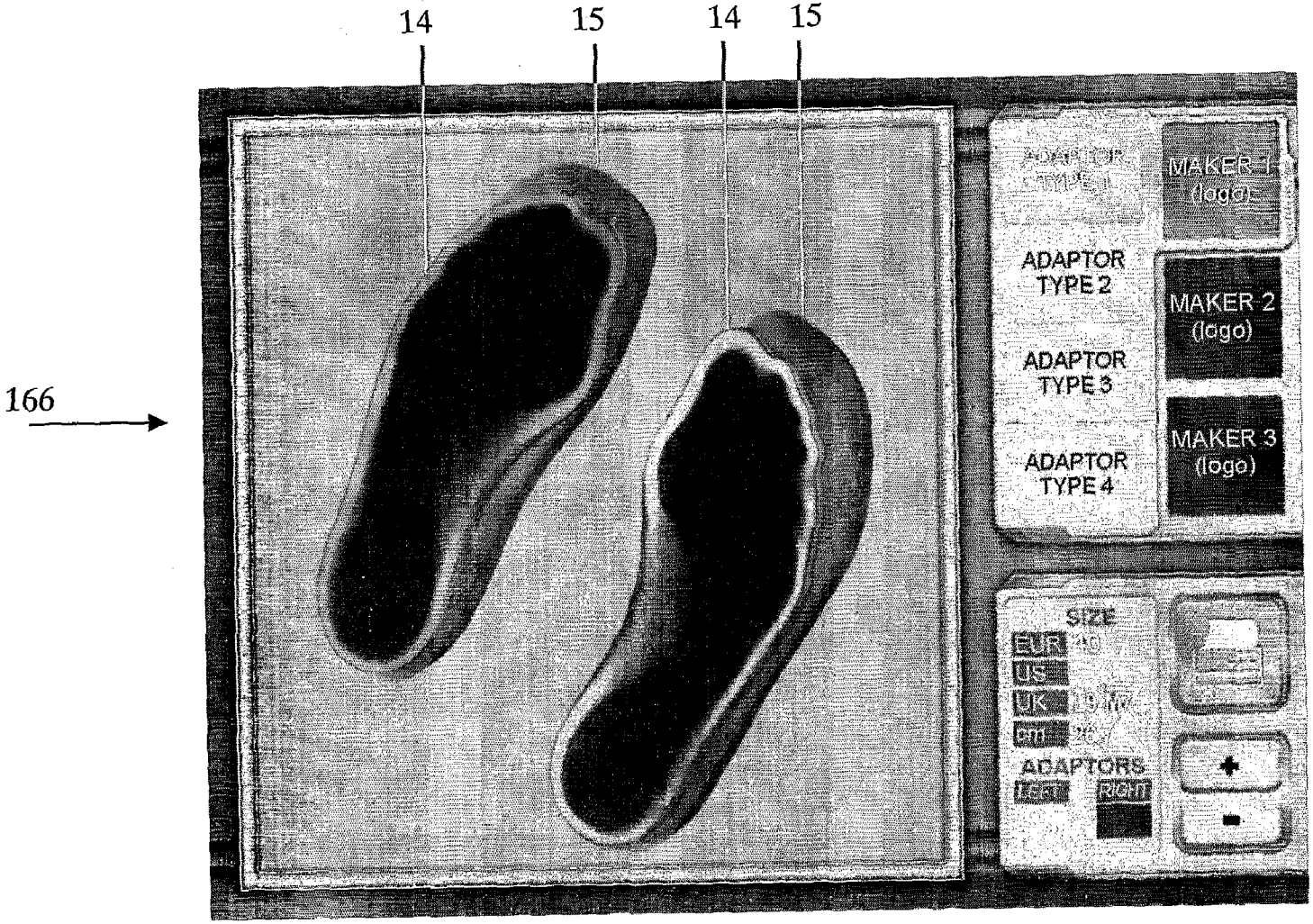
Figures 14A, 14B, 14C, 14D, 14E:
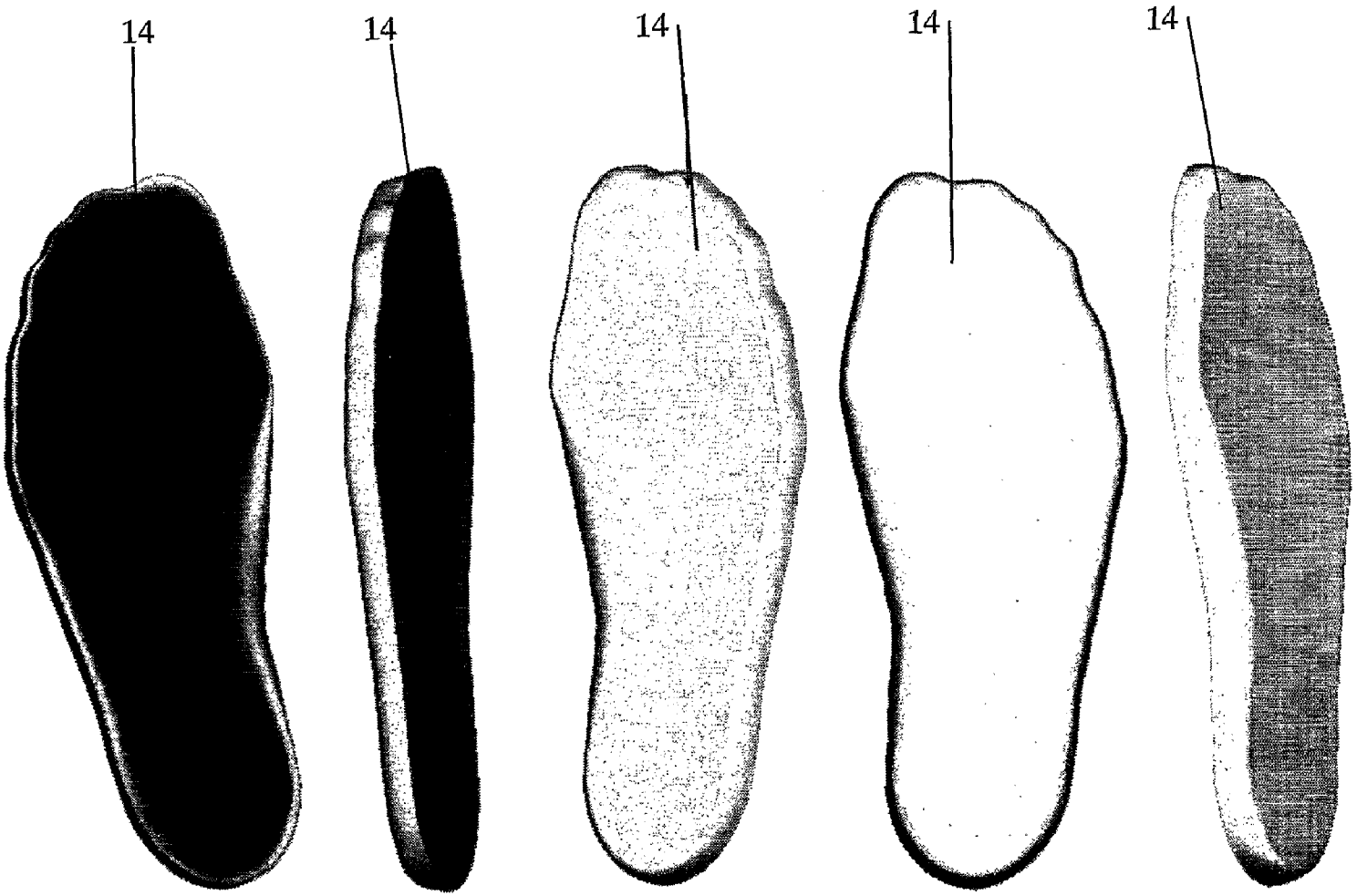
FIGS. 14A-14E schematically illustrate different views of a virtual foot plaster cast, in accordance with an embodiment of the present invention.
Figure 15C:
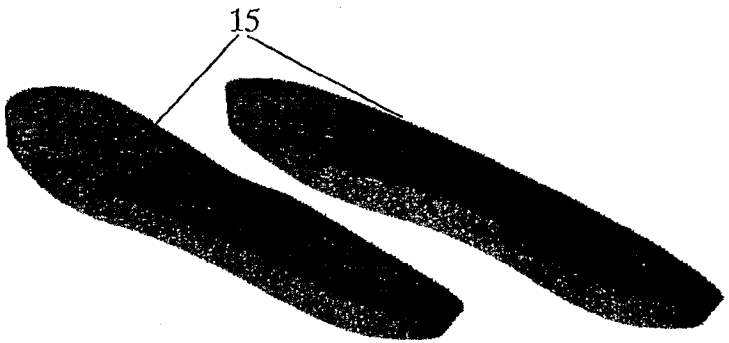
FIGS. 15A-15D schematically illustrate different views of a three-dimensional image of an insole adapter, in accordance with an embodiment of the present invention.
Figure 15D:
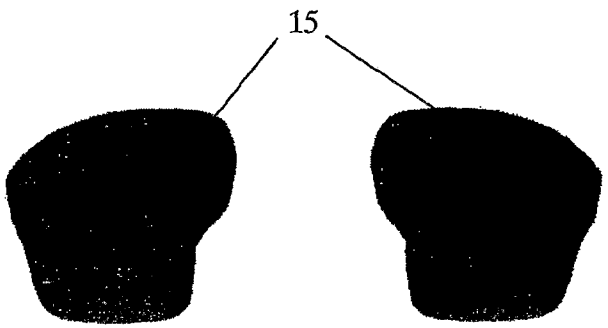
Figure 15B:
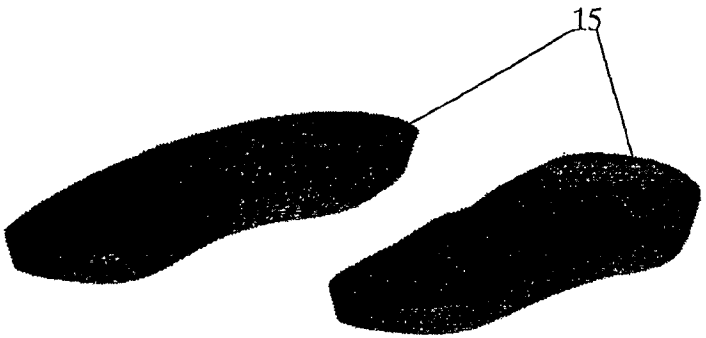
Figure 15A:
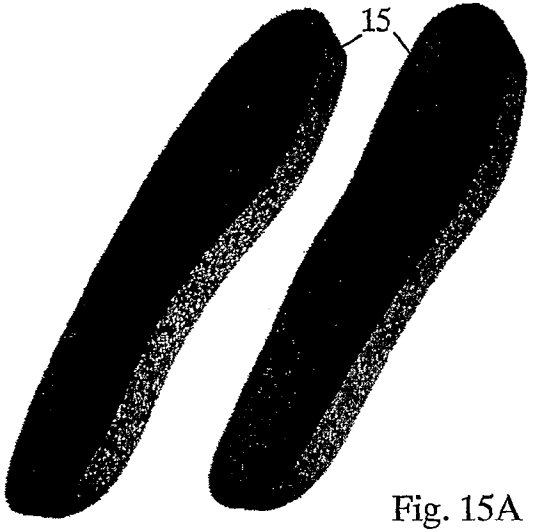

The "−" button 149 is used in cases where a customer walks in with very swollen feet after a long day of walking and in cases of kidney patients with swollen feet before dialysis. In this case, the customer receives 2 different sets of adapters, one for the state of their feet before dialysis and the other for the state of their feet after dialysis. FIG. 13F shows one image from the visualization clip showing the three-dimensional model of the feet 14 (FIGS. 14A-14E) and the selected adapters 15 (FIGS. 15A-15D) from different angles.

FIGS. 14A-14E show different view angles of three-dimensional plaster cast 14. Three-dimensional model planar texture mapped, built using the foot image 13, the data of outer outline 10 for upper side and inner outline 11 for bottom side. This resembles a personal "plaster cast" of the sole of the foot that comes into contact with the adapter.

FIGS. 15A-15D show three-dimensional models of adapter-insoles 15 shown in different angles of views.

Shoe Fitting Method Descriptions

Figure 8A:
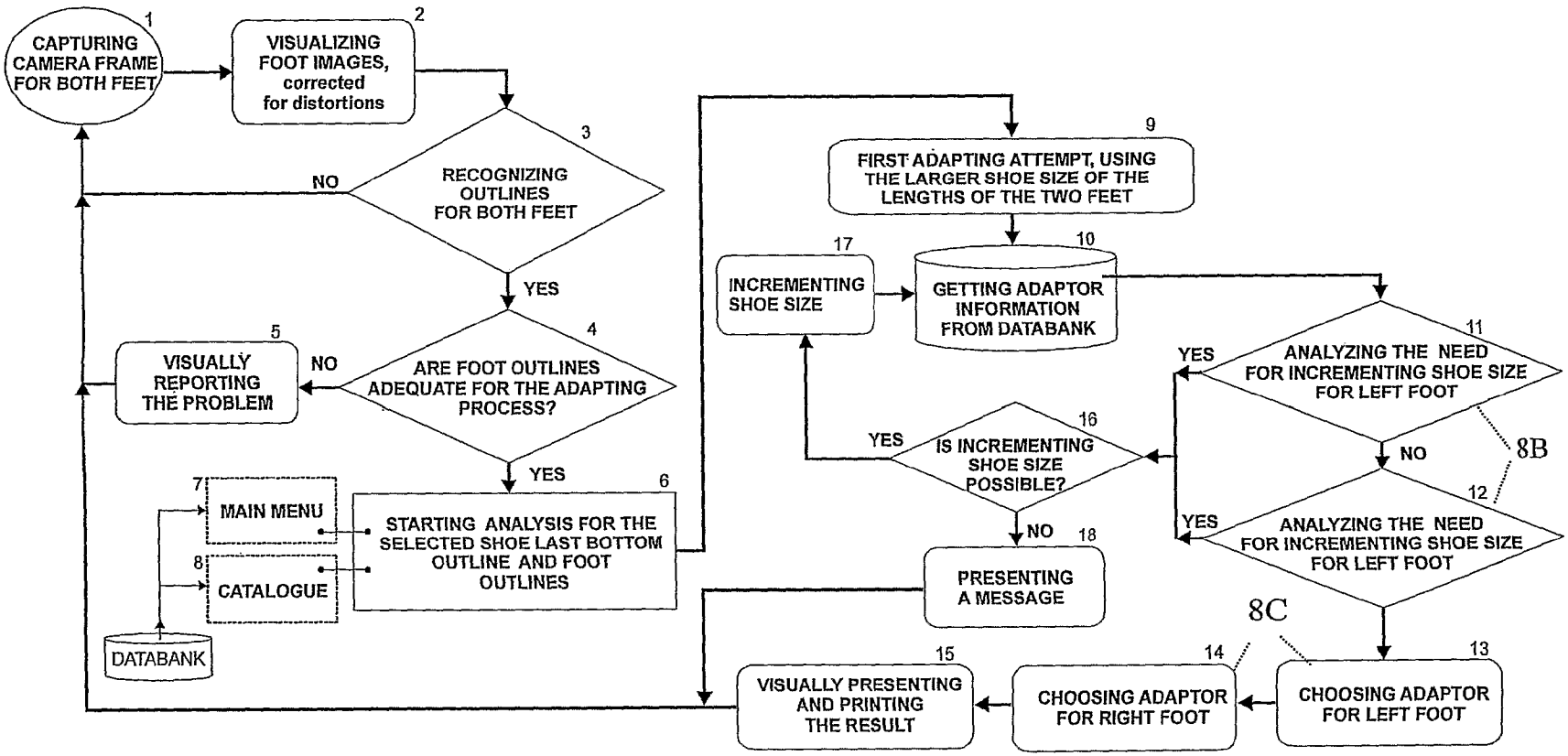
FIG. 8A is a flow chart that schematically illustrates a method for automated shoe fitting, in accordance with an embodiment of the present invention.

FIG. 8A illustrates, in flowchart form, a method for automated shoe fitting, in accordance with an embodiment of the present invention. The method is typically carried out by processor 83. The flowchart is described in stages, as follows:

Stage 1—a streaming video is started, with two cameras 102 (FIG. 101) photographing alternately.

Stage 2—a video stream 13 of the two feet is projected on the screen (FIG. 13A). Each video picture is corrected for distortions.

Stage 3—Concurrently with the image capture of video stream 13, stage 3 begins, involving a preliminary process of finding outlines around each foot for a quick determination if a person has mounted the apparatus.

Stage 4—In stage 4, the inner foot outline 11 and the foot outline 10 already exist as shown in FIG. 13A. The detected foot outline 10 is examined automatically, to determine whether it complies with the definitions of a foot, based on measures such as, an amount of typical illumination, continuity of the outlines, angles and radii characteristic of the right and left feet, number of pixels at the different levels of brightness, etc.

Stage 5—error messages are displayed on the screen 160 (FIG. 13C) if the customer, who is measured, is not standing correctly on the apparatus. The nature of the error is presented in a text format or as an icon 138.

If the foot outline images 13 are found satisfactory, the "analyze button" 134 is turned on to "enabled mode" (137 lighted). The fitting process can then proceed.

Stage 6—feet outlines 10 and 11 are known and tested. The type of adapter-insole 40 for the fitting (adapting) can be selected directly from the main menu signed as 7 (screen 160 FIG. 13A) by pressing the manufacturer's name 131 and the adapter-insole type 132.

Alternatively, the type of adapter 40 may be selected from the catalog signed as 8 (screen 164 FIG. 13D).

Stage 9—upon entry to Stage 9, outlines 10 and 11 of feet images 13 (FIG. 13A) and last bottom outlines 20 of the selected shoes are already known. Stage 9 is designed to save on processing time and to define a preliminary size, based on a comparison of the length of the longer foot outline 10 to the last bottom outlines 20.

Stage 10—in stage 10, the 3D data and the last bottom outlines 20 for the adapter of the specified type and size are retrieved from databank 89 for subsequent use.

Stages 11 and 12—these stages are identical and sequential. Each (described in FIG. 8B) operating on the left and right feet. An important part of the selection process, at this stage, is taking into consideration the possibility of increasing the width by using an adapter 44A with a larger volume or low thickness rather than incrementing the shoe size.

The aim of stages 11 and 12 is to determine the size of the shoe required for the larger one of the two feet. Stages 11 and 12 constitute the stage in which the "platform" for the fitting is selected; that is, the selection of the size of shoes in which the final fitting ("fine tuning") will be made using the adapters 40, which will complement the selected shoe size, in stages 13 and 14. Stages 13 and 14 are described in detail in conjunction with FIG. 8C, herein below.

Stage 15—stage 15 displays the results of the fitting visually, for example, on screen 136 in FIGS. 13E and 13F, using a three dimensional foot model 14 and a three dimensional image 15 of the adapter 40. Additionally or alternatively, stage 15 displays the result on demand as printout 115 (FIG. 12).

Figure 8B:
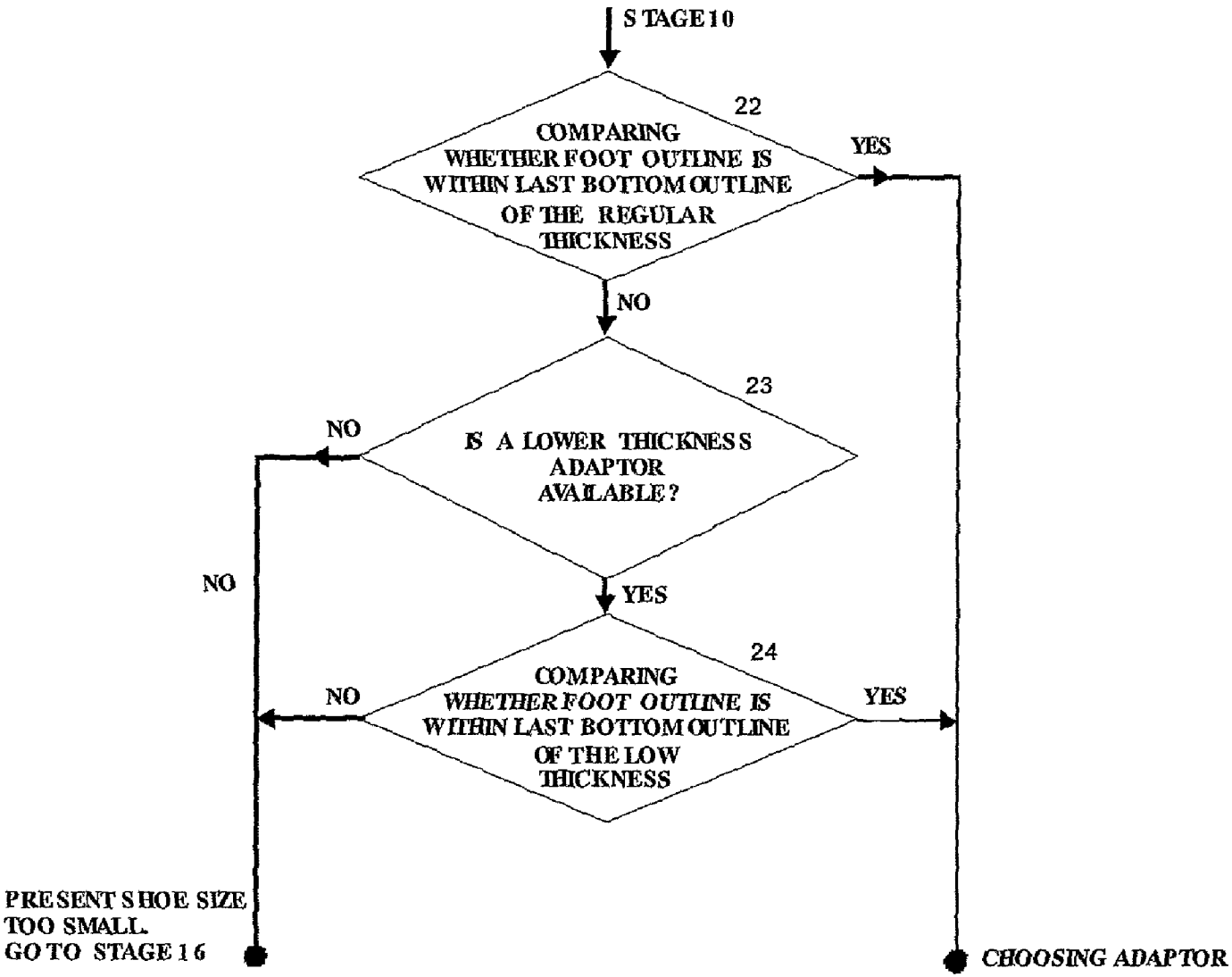
FIG. 8B is a flow chart that schematically illustrates a method for determining to increment a shoe size, in accordance with an embodiment of the present invention.

FIG. 8B illustrates, in flowchart form, an analysis of a need to increment the shoe size, in accordance with the present invention. FIG. 8B relates to stages 11 and 12 in FIG. 8A. Stages 19 to 21 in FIG. 8B last vacant for future use.

Stage 22—stage 22 compares the foot outline 10 with the last bottom outline 20 of regular thickness, if the comparison finds that the foot should slip comfortably to the last bottom outline 20, the process proceeds to the other foot.

If both feet slip comfortably, the process continues to stages 13 and 14, for choosing adapter-insoles.

If the foot outline 10 is wide, at a certain portion of it, relative to the last bottom outline 20, the process continues to stage 23.

Stage, 23—stage 23 checks, before incrementing the shoe size, whether the volume can be increased by choosing a thinner adapter 40A, for providing the foot with a higher inner volume 44A (FIGS. 7E-7F). If no such adapter exists in stock, the shoe size must be incremented in stage 16. If a thinner adapter 44A does exist, the process continues to stage 24.

Figures 9A, 9B, 9C, 9D:
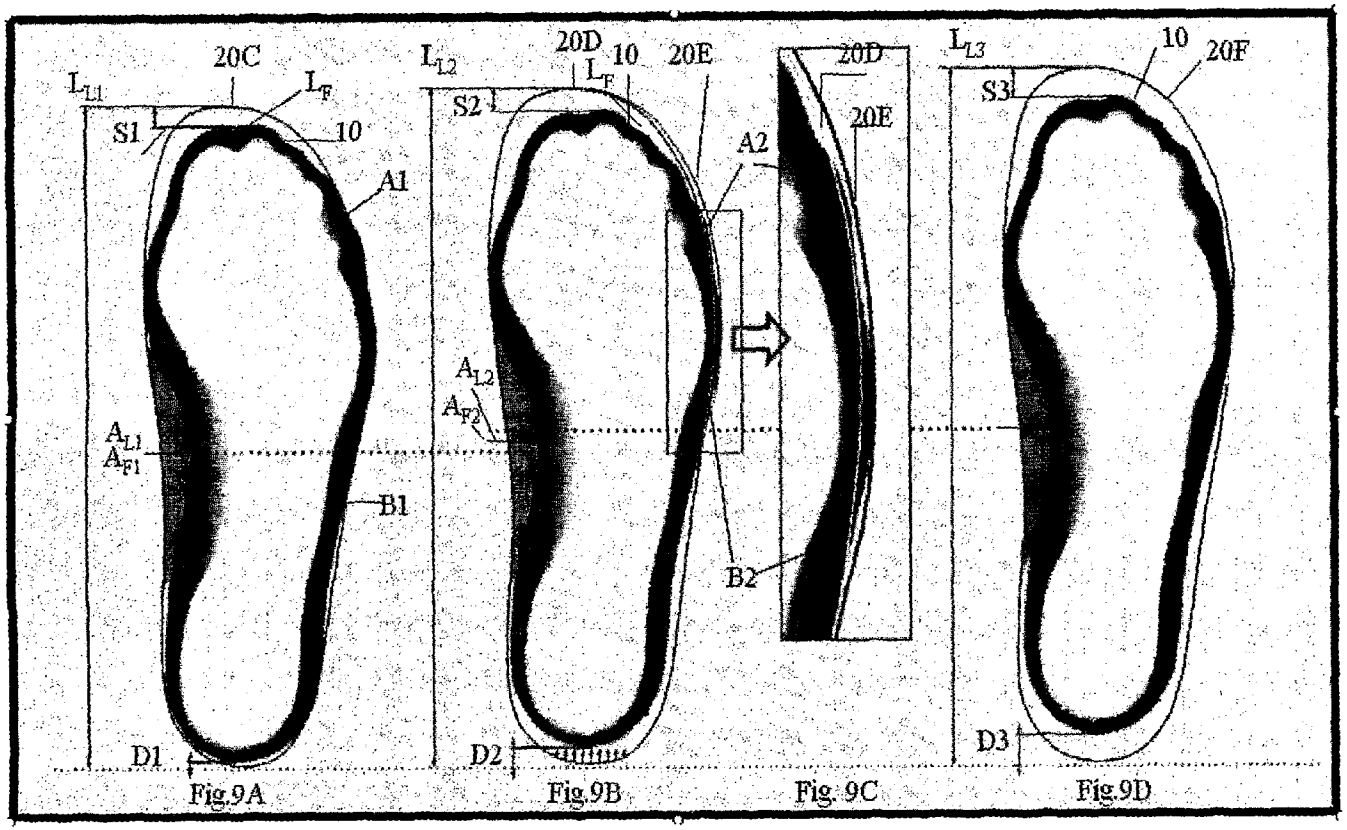
FIGS. 9A-9D are diagrams that schematically illustrate a method for treating a foot outline, which is wide in relations to a last-bottom outlines, in accordance with an embodiment of the present invention.

Stage 24—stage 24 makes a comparison of foot outline 10 with the virtual wider last bottom outline 20E as shown in FIGS. 9B and 9C depicting the equivalent width of the shoe after the added volume by the adapter 44A.

If a fit is achieved, than proceed to the next foot or to fitting adapters in stages 13 and 14. In the absence of a fit and part of foot outline 10 wider than virtual wider last bottom outline 20E, there is no choice but to increase the shoe size in stage 16.

Figure 8C:
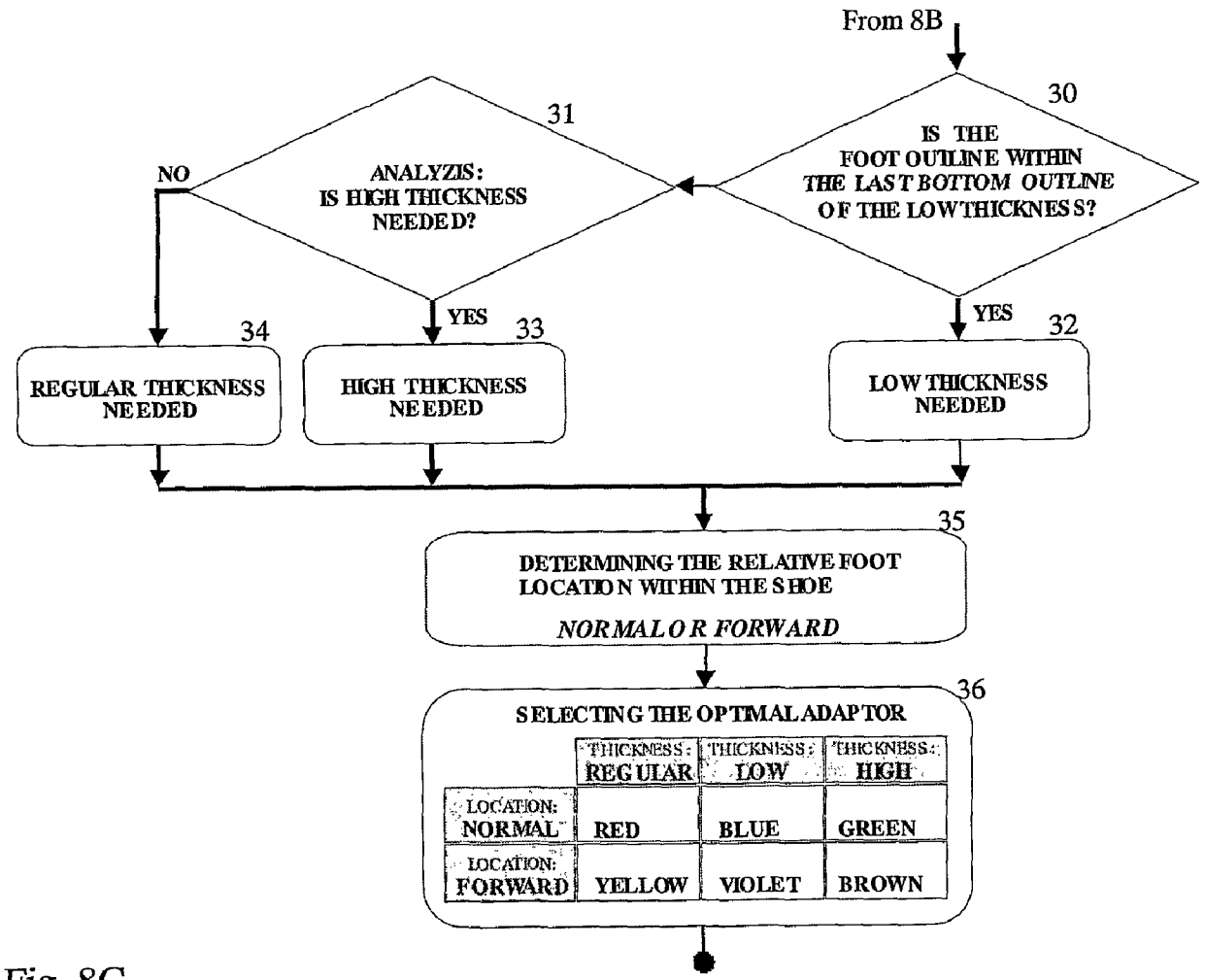
FIG. 8C is a flow chart that schematically illustrates a method for selecting an insole adapter for each foot, in accordance with an embodiment of the present invention.

FIG. 8C illustrates, in flowchart form, an analysis for choosing an adapter-insole for each foot as shown in FIG. 8A. Stages 25 to 29 in FIG. 8C last vacant for future use.

Stages 13 and 14—stages 13 and 14 are typically identical and sequential. Each stage is responsible for screening one foot for the adapter appropriate to it: Stage 13 for the left foot and Stage 14 for the right foot. Choosing an adapter starts with the following known factors: the shoe size, type of adapter, and knowledge as to whether adapter-insole 40A with increased volume 44A has been selected for the left or the right feet, or both.

Stages 30 and 32—stage 30 examines a situation when an adapter with a large volume has not selected. For this situation, there are two options, stages 33 and stages 34. Stage 32 applies to cases where adapter of large volume has selected Stage 33—stage 33 applies to cases where the foot outline 10 is narrow in relation to the recommended last bottom outline 20 and adapter-insole 40C is required, to provide the shoe with reduced inner volume 44C.

Stage 34—stage 34 applies to cases where the width of the foot outline 10 is just right for the last bottom outline 20, and an adapter having regular thickness like 40B is required.

Stages 35 and 36—the optimal adapters are selected in stages 35 and 36, for the left and right feet, after the shoe size and the individual thickness of the adapter for each foot have been determined. These stages check whether the selected shoe size is large in relation to the length of the foot. If, for the fitting, the shoe was incremented beyond the foot by more than one length size the foot needs a back support 58D (FIG. 7D) in order not to slide back and forth inside the shoe. At the exit from these stages, all the information for the fitting is available, including the size of the pair of shoes and the adapter for each foot.

Figure 8D:
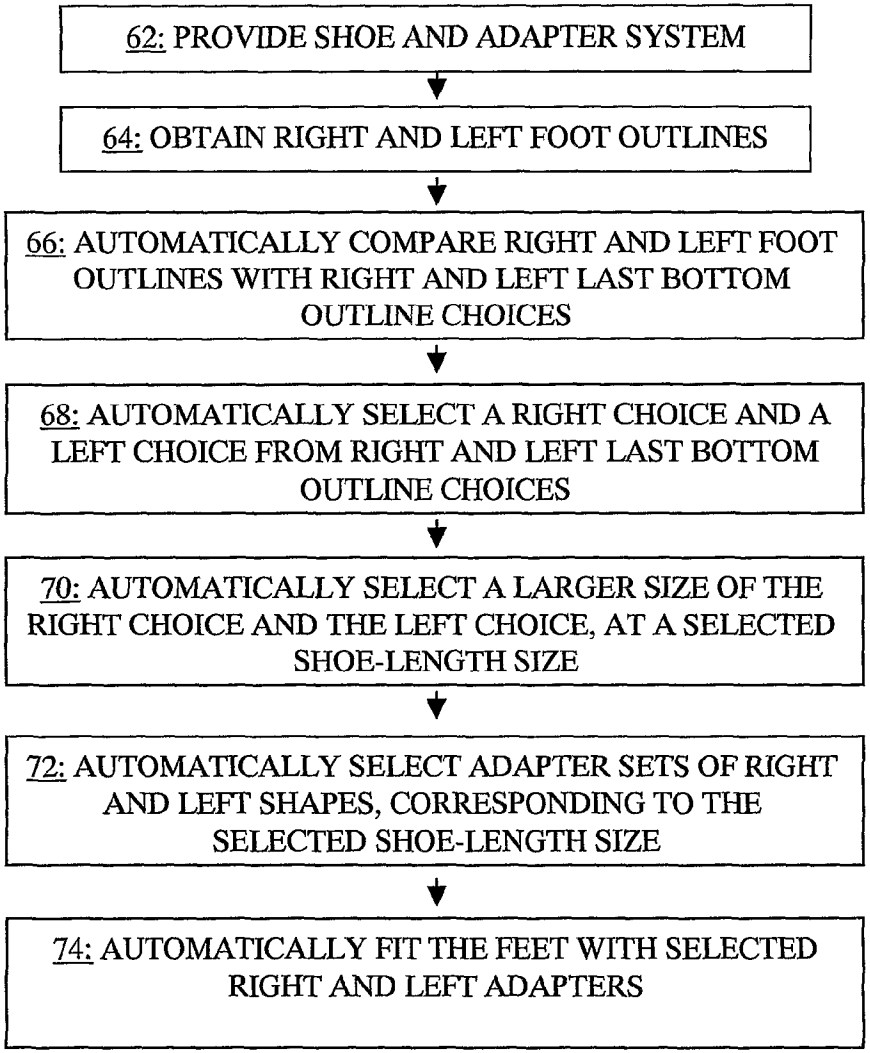
FIG. 8D is a flow chart that schematically illustrates a method for automated shoe fitting, in accordance with another embodiment of the present invention.

FIG. 8D illustrates, in flowchart form, a method for automated shoe fitting, in accordance with another embodiment of the present invention. The method comprises the following steps:

in box 62: providing the shoe-and-adapter-insole system 30, which includes a first plurality of mass-produced shoes 32, of varying shoe-length sizes, each of the sizes provided in right and left shapes, the shoes defining last-bottom outlines 20 of specific sizes and right and left shapes and further defining initial inner volumes 34, in which standard insoles, corresponding to the specific sizes and shapes, can be inserted, wherein the shoes are provided without the standard insoles, and a same plurality of adapter sets, corresponding to the varying shoe-length sizes and right and left shapes, wherein each of the adapter sets includes at least two interchangeable adapters, having identical outlines but different topographies, and being configured for insertion to shoes, corresponding in size and shape, thus providing the shoes with adjustable final inner volumes 44A, 44B and 44C;

in box 64: obtaining right and left foot outlines 10 and 11;

in box 66: automatically comparing the weighted right and left foot outlines (combined from outline 10 and 11) with right and left last-bottom-outline 20 choices, the right and left last-bottom-outline choices varying by their respective lengths;

in box 68: automatically selecting a right choice and a left choice from the right and left last-bottom-outline 20 choices, based on the comparing;

in box 70: automatically selecting a larger size of the right choice and the left choice, as a selected shoe-length size;

in box 72: automatically selecting adapter sets of right and left shapes, both corresponding to the selected shoe-length size; and in box 74: automatically fitting the feet with right and left adapter from the sets of interchangeable adapter, independently for each of the feet, to optimize a fit for each of the feet within the selected shoe-length size, based on the comparing.

FIGS. 9A-9D schematically illustrate a manner of treating a foot outline 10 which is wide in relations to a last-bottom outlines, in accordance with the present invention. These figures illustrate a foot outline 10, in relation to different last bottom outlines 20C-20F of a same design but sequentially increasing length sizes.

As seen in FIG. 9A, of the foot outline 10 and the last bottom outline 20C, the foot outline 10 has an arch, centered at a location $A_{F1}$ which is correctly placed in relations to the last arch, centered at $A_{L1}$. (It will be appreciated that the location of the arch center is proportional to the foot length.)

Additionally, the foot outline 10 has a length $L_F$, which fits within the last bottom length $L_{L1}$, as illustrated by an acceptable length delta S1 and distance D1. However, a portion A1-B1 of the foot outline 10 protrudes from the last bottom outline 20C.

As seen in FIG. 9B, an attempt to address the protrusion of the foot leads to the selection of a last bottom outline 20D, which is one length size greater than the last bottom outline 20C. Still, the portion A2-B2 of the foot outline 10 protrudes from the last bottom outline 20D.

Figures 2D, 2E, 2F, 2G:
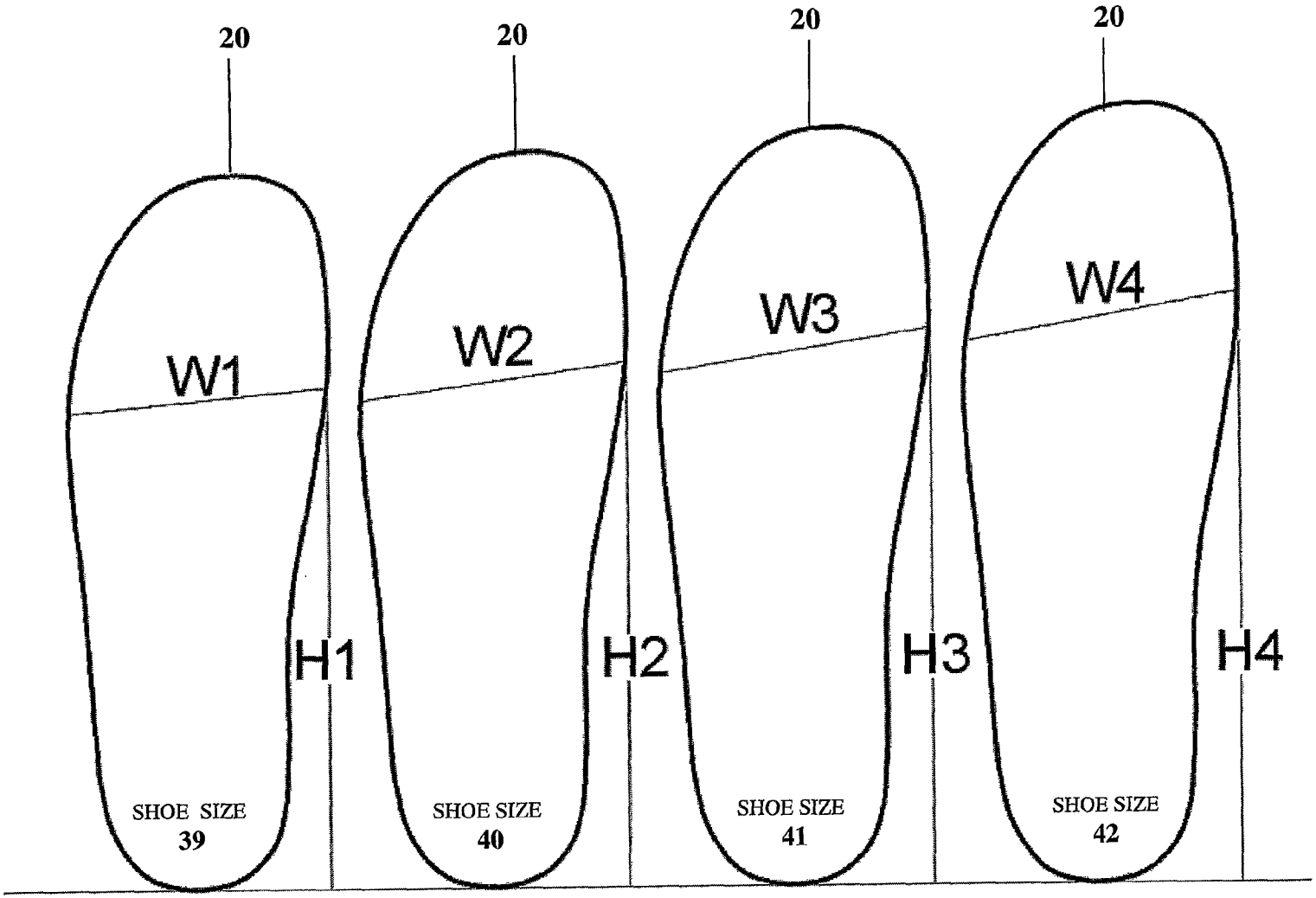
FIGS. 2D-2G are diagrams that schematically illustrate last bottom outlines having the same shoe design and different sizes, in accordance with an embodiment of the present invention.

As seen in FIG. 9B and as taught in conjunction with FIGS. 2D-2G and 7D, a heel-back-support section 58D may be used for pushing the foot outline 10 forward to D2. This action has three advantages:

i. the location of foot arch, centered at $A_{F2}$ will be correctly placed in relations to the last-bottom arch, centered at $A_{L2}$;

ii. the foot length $L_F$ fits within the last bottom length $L_{L2}$, as illustrated by an acceptable length delta S2.

iii. the last bottom outline 20D is wider at higher location as illustrated better in FIGS. 2D-2F, so portion A1-B2 is less likely to protrude, at the new location.

However, in some situations, it may be that the foot outline 10 is still too wide, and the portion A2-B2 still protrudes from the last bottom outline 20D. It is thus necessary to use an adapter 44A that will increase the inner volume of the shoe (FIG. 7F), producing a virtual wider last bottom outline 20E for comparing with foot outline 10.

The portion A2-B2 of the foot outline 10 fits within the greater volume 44A of the virtual wider last bottom outline 20E. This is further illustrated in expanded view FIG. 9C.

FIG. 9C, shows wider last bottom outline 20E, generated by increasing the shoe width size. It may be achieved by either increasing the shoe girth, as is commonly done in the art, or by using adapter 40A of a lower topography (FIGS. 7E-7F) which provides a greater inner volume to the shoe.

As a consequence, the use of adapter-insoles 40A-40C, in accordance with the teachings of the present invention is analogous to moving between shoes of different shoe width sizes Given that the foot outline 10 has a portion A2-B2 which protrudes the last bottom outline 20D (FIG. 9B), one would have to move on to still a higher size. This is shown in FIG. 9F which illustrates a situation that would result without the heel-back-support section 58D and without the adapter-insole 40A, which provides the greater inner volume 44A (FIG. 7F). Clearly, the shoe will be much longer than the foot, and the foot may move about within the shoe as seen at distance D3 and delta S3.

Figure 16:
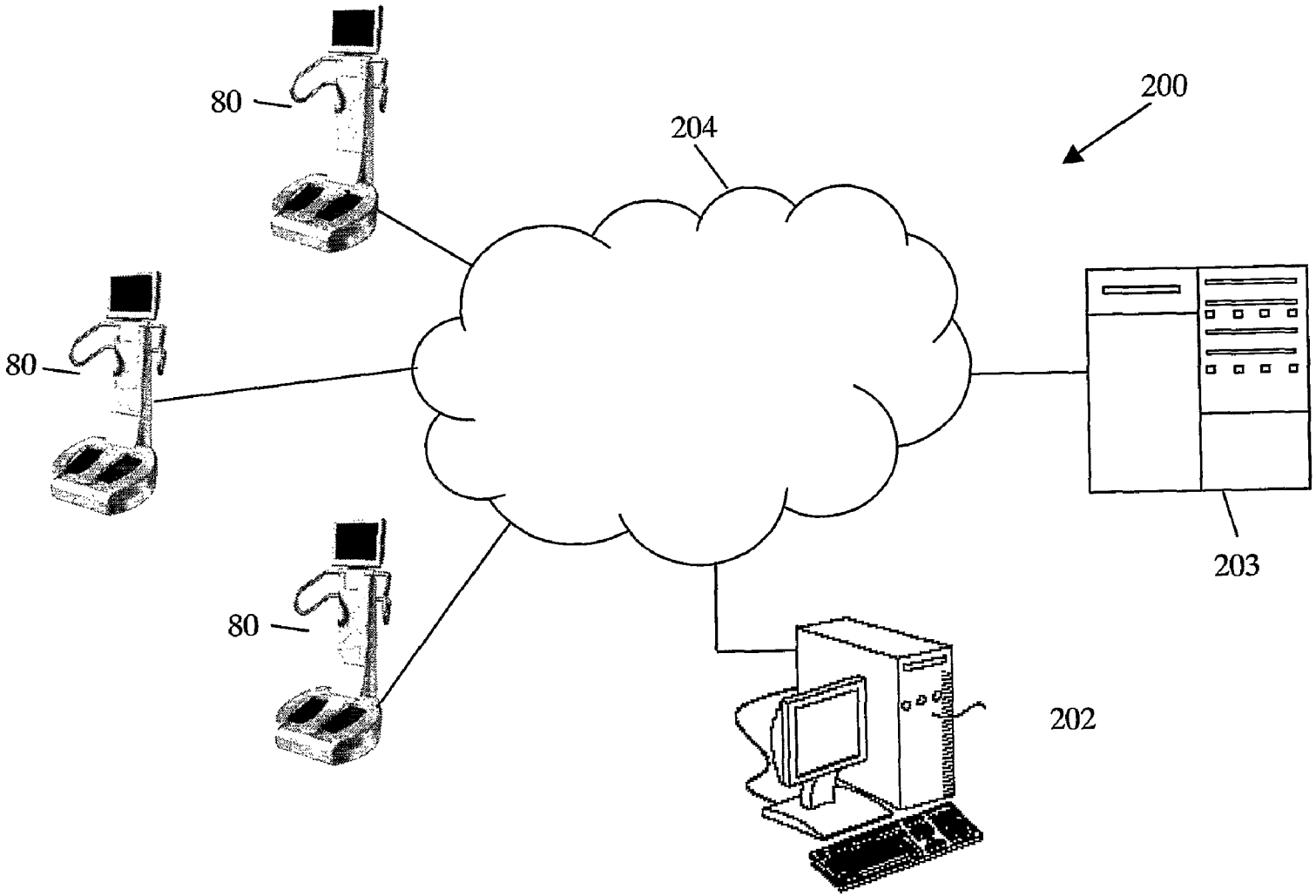
FIG. 16 is a block diagram that schematically illustrates a distributed system for automated shoe fitting, in accordance with another embodiment of the present invention.

FIG. 16 is a block diagram that schematically illustrates a distributed system 200 for automated shoe fitting, in accordance with another embodiment of the present invention. In some cases, it is desirable to separate the measuring process from the fitting of the shoes. For example, shoes are often purchased over the Internet. In known on-line retail applications, the buyer cannot measure or fit the shoes prior to purchasing them, an issue that often limits the success of Internet-based shoe retail applications.

In the exemplary embodiment of FIG. 16, system 200 comprises multiple measuring stations 80, which are placed at suitable public locations, such as at shopping malls. The measuring stations are connected through a wide area network (WAN) 204, such as the Internet, to a fitting station included DB and fitting program. A customer performs a measuring session at one of the measuring stations. At the end of the session, the station produces a receipt, similar to the receipt of FIG. 12 above (without the fitting results). The receipt comprises a unique identification number, such as a number that is calculated based on a serial number of the measuring station and on the time-of-day in which the fitting session occurred. Alternatively, the station may be requested to transmit the receipt and/or identification number to the customers e-mail address, or send it using a short message service (SMS) to the customer's mobile phone. In some embodiments, the customer may be requested to pay a symbolic price for the fitting session, mainly to avoid abuse of the system.

After measuring, the customer may access a web-site 203 of the selected shoe manufacturer or vendor from any Internet-capable computer 202, in order to make the purchase. As part of the purchase, the customer can enter the unique identification number provided by the measuring station, instead of specifying a shoe size and/or model. The online shop transfers the details to fitting station includes the selected shoe and ID (defined by last). The fitting station response the fitting results to online shop and than to the customer. Using this method, the customer may purchase a pair of shoes over the Internet, without compromising the ability to measure and fit their size.

In some embodiment, the database of shoe manufacturers, shoe designs and insole adapter sets is located at a central fitting station location, which is accessed by all fitting stations. For example, the database may be located at web server 203.

Adapters constructed in accordance with the present invention for a particular shoe last may alternatively comprise one or more inserts applied to a part of an insole, e.g., the forefoot section, for varying the thickness of that section or insert for pushing the foot forward.

In some embodiments, the system elements performing shoe measurement, fitting and purchasing may be connected to one another using a wireless network, such as by using suitable cellular modems.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art.

The invention claimed is:

1. A method of finishing unfinished shoes according to feet of a customer, comprising:

providing a plurality of unfinished pairs of shoes in different sizes and in different styles, each having an insole outline and an inner volume defined by a shoe last from a plurality of shoe lasts in various sizes;

providing sets of left and right interchangeable insole adapters insertable into the unfinished shoes;

generating, for each unfinished shoe in each size, a set of volumetric weighted adaptor outlines based on the insole outline of the unfinished shoe and normalized in respect to the inner volume, wherein each outline of the set is associated with a remnant free volume impounded between a forefront top of the unfinished shoe and a surface of each of the corresponding insole adaptor;

capturing a computer-readable image of each of the feet, by capturing light reflected from each foot;

identifying, by image processing, from the captured images, for each customer's foot, outer foot outlines defined as outer boundaries of the foot, and inner foot outlines defined as outlines of weight-bearing areas of the foot;

calculating a weighted foot outline of each foot based on the outer and inner foot outlines considering fitting factors;

comparing, for each foot, the weighted foot outline to the volumetric weighted adaptor outline of a corresponding shoe of an at least one customer selected shoe style; and calculating, from the comparison, for each customer selected shoe style and for each foot, a customer shoe size and a customer insole adapter that allow a best fitting of an unfinished shoe, to the customer's foot comprising the corresponding shoe and the customer insole adapter inserted there-within, wherein the customer insole adapter is selected such as to provide the remnant free volume that allows for optimal fitting of foot volume, wherein the calculated insole adapters inserted into each shoe allow finishing the unfinished shoes such as to provide customized fitting of the finished shoes to each of the customer's feet.

2. The method according to claim 1, further comprising: recalculating, if the calculated shoe sizes differ between the left and right foot, for a smaller foot a higher shoe size in respect to the comparison; and calculating a best fitting insole adapter for the smaller foot under constraints imposed by the volumetric weighted adaptor outlines and by the weighted foot outlines.

3. The method according to claim 1, further comprising turning finished pairs of shoes to corresponding unfinished pairs of shoes by removing factory made insoles therefrom.

4. The method according to claim 1, wherein the sets of interchangeable insole adapters corresponding to the unfinished shoes of each size have different volumes in their front sole with respect to one another, such that each unfinished shoe with corresponding interchangable insole adapters, has different remnant free volumes corresponding to different shoe width sizes.

5. The method according to claim 1, wherein at least some of interchangeable adaptors include a forward-pushing heel section.

6. The method according to claim 1, wherein at least some of the adaptors in the set differ from other adaptors in the set in the shape or location of an arch section.

7. The method according to claim 1, wherein the sets of interchangeable insole adapters corresponding to the unfinished shoes of each size are color-coded.

8. The method according to claim 1, wherein the sets of left and right interchangable insole adapters comprise a single set.

9. The method according to claim 1, wherein the capturing the computer-readable image comprises:

placing the feet of the user wearing socks on a platform substantially transparent to near infra red (NIR) and substantially opaque to visible light;

irradiating the circumference of each foot using a collimated near infra red light source parallel to the platform on which the feet are placed; and capturing the NIR light reflected from the feet through the platform using a camera so as to obtain the computer-readable images.

10. The method according to claim 1, wherein calculating the weighted foot outline comprises:

dividing a long side of outer and inner foot outlines into regions having respective levels of fitting significance between inner and outer outline;

analysing, from the division, a pattern of the foot shape; and constructing, from the analysis of the pattern and with respect to each region, the weighted foot outline for each foot.

11. The method according to claim 1, wherein the calculating the customer shoe size and the customer insole adapter is carried out by stepwise increasing the shoe size, and for each shoe size stepwise decreasing adapter volume such as to increase from a small remnant volume to a large remnant volume within each shoe size.

12. A system for finishing unfinished shoes according to feet of a customer, comprising:

a plurality of unfinished pairs of shoes in different sizes and in different styles, each having an insole outline and an inner volume defined by a shoe last from a plurality of shoe lasts in various sizes;

at least one set of left and right interchangable insole adapters insertable into the unfinished shoes;

a shoe outline unit arranged to generate for each unfinished shoe in each size, a set of volumetric weighted adaptor outlines based on the insole outline of the unfinished shoe and normalised in respect to the inner volume, wherein each outline of the set is associated with a remnant free volume impounded between a forefront top of the unfinished shoe and a surface of each of the corresponding insole adaptor;

a foot imaging unit arranged to capture a computer-readable image of each foot, by capturing light reflected from each foot; to identify outer foot outlines defined as outer boundaries of the foot, and inner foot outlines defined as outlines of weight-bearing areas of the foot;

a data base unit arranged to store volumetric weighted adaptor outlines data derived from the shoe outline unit for each selected unfinished shoe and its respective set of adaptors and foot outlines of at least one customer derived from the foot imaging unit;

a finishing unit, arranged to calculate a weighted foot outline of each foot of the customer based on a foot pattern and specified foot regions derived from the of outer and inner foot outlines; and arranged to compare, for each foot, the weighted foot outlines to the volumetric weighted adaptor outlines of a corresponding shoe of an at least one customer selected shoe style;

and to calculate from the comparison, for each customer selected shoe style and for each foot, a customer shoe size and a customer insole adapter that allow a best fitting of a finished shoe, comprising the corresponding shoe and the customer insole adapter inserted therewithin, to the customer's feet, wherein the customer insole adapter is selected from the set of adaptors such as to provide the remnant free volume that allows for optimal fitting of foot volume, wherein the calculated insole adapters inserted into each shoe allow finishing the unfinished shoes such as to provide customised fitting of the finished shoes to each of the customer's feet.

13. The system according to claim 12, wherein the finishing unit is further arranged to recalculate, if the calculated shoe sizes differ between the left and right foot, for a smaller foot a higher shoe size in respect to the comparison—a best fitting insole adapter for the smaller foot under constraints imposed by the volumetric weighted adaptor outlines and by the weighted foot outlines.

14. The system according to claim 12, further comprising an insole remover arranged to turn finished pairs of shoes to corresponding unfinished pairs of shoes by removing factory made insoles therefrom.

15. The system according to claim 12, wherein the sets of interchangeable insole adapters corresponding to the unfinished shoes of each size have different volumes in their front sole with respect to one another, such that each unfinished shoe with corresponding interchangable insole adapters, has different remnant free volumes correspnding to different shoe width sizes.

16. The system according to claim 12, further comprising a sale unit arranged to display the plurality of unfinished shoes enabling the customer to select its own prefered design of unfinished shoe; to display the calculated results driven from finishing unit including shoe size and type of insole adapters for finishing the selected shoes; and to enable the customer purchase the finished shoes.

17. The system according to claim 16, wherein the data base unit, the sale unit, the finishing unit and the foot imaging unit are integrated in one apparatus located in an inventory site that stores the plurality of unfinished shoes and the sets of insole adaptors.

18. The system according to claim 12, wherein the sets of left and right interchangable insole adapters comprise a single set.

19. The system according to claim 12, wherein the foot imaging unit comprises:

a platform substantially transparent to near infra red (NIR) and substantially opaque to visible light, the platform arranged to support the customer's feet;

a collimated near infra red light source arranged to irradiate the circumference of each foot parallel to the platform; and a camera arranged to capture the NIR light reflected from the feet through the platform using so as to obtain the computer-readable images.

20. The system according to claim 12, wherein the finishing unit is arranged to divide a long side of outer and inner foot outlines into regions having respective levels of fitting significance between inner and outer outline; to analyse, from the division, a pattern of the foot shape; and to construct, from the analysed pattern and with respect to each region, the weighted foot outline for each foot.

21. The system according to claim 12, wherein the finishing unit is arranged to calculate the customer shoe size and the customer insole adapter by stepwise increasing the shoe size, and for each shoe size stepwise decreasing adapter volume such as to increase from a small remnant volume to a large remnant volume within each shoe size.

22. The system according to claim 16, wherein at least two of: the shoe outline unit; the foot imaging unit; the database unit; the finishing unit and the sale unit are physically remote and are interconnected via a communication link.

23. The system according to claim 16, wherein the finishing unit and the data base unit are located together on same central server and connected to at least one sale unit through communication link for receiving request for finishing unfinished shoe selected by customer at sale unit and sending back response for finishing the selected shoe according to customer's feet.

* * * * *